US009958801B2

(12) United States Patent
Tanaka et al.

(10) Patent No.: US 9,958,801 B2
(45) Date of Patent: May 1, 2018

(54) TONER AND PRODUCTION METHOD THEREOF

(71) Applicant: CANON KABUSHIKI KAISHA, Tokyo (JP)

(72) Inventors: Masatake Tanaka, Yokohama (JP); Yoshihiro Nakagawa, Numazu (JP); Naoya Isono, Suntou-gun (JP); Harumi Takada, Susono (JP); Reo Tagawa, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/152,313

(22) Filed: May 11, 2016

(65) Prior Publication Data

US 2016/0334727 A1 Nov. 17, 2016

(30) Foreign Application Priority Data

May 14, 2015 (JP) ..... 2015-098778

(51) Int. Cl.
*G03G 9/087* (2006.01)
*G03G 9/08* (2006.01)

(52) U.S. Cl.
CPC ..... *G03G 9/08786* (2013.01); *G03G 9/0806* (2013.01)

(58) Field of Classification Search
CPC ..... G03G 9/08755; G03G 9/08711
See application file for complete search history.

(56) References Cited

U.S. PATENT DOCUMENTS

| | | | | |
|---|---|---|---|---|
| 4,931,375 | A * | 6/1990 | Akimoto | G03G 9/08788 430/109.3 |
| 4,960,669 | A | 10/1990 | Mori et al. | |
| 6,569,589 | B2 | 5/2003 | Inaba et al. | |
| 7,833,685 | B2 | 11/2010 | Tanaka et al. | |
| 8,367,289 | B2 | 2/2013 | Isono et al. | |
| 8,377,616 | B2 | 2/2013 | Tani et al. | |
| 8,431,304 | B2 | 4/2013 | Sugimoto et al. | |
| 8,440,382 | B2 | 5/2013 | Isono et al. | |
| 8,497,054 | B2 | 7/2013 | Sugiyama et al. | |
| 8,603,712 | B2 | 12/2013 | Aoki et al. | |
| 8,628,899 | B2 | 1/2014 | Kawamura et al. | |
| 8,652,737 | B2 | 2/2014 | Handa et al. | |
| 8,741,519 | B2 | 6/2014 | Watanabe et al. | |
| 8,778,581 | B2 | 7/2014 | Nonaka et al. | |
| 8,815,484 | B2 | 8/2014 | Tanaka et al. | |
| 8,828,633 | B2 | 9/2014 | Itabashi et al. | |
| 8,846,284 | B2 | 9/2014 | Kinumatsu et al. | |
| 9,158,216 | B2 | 10/2015 | Shimano et al. | |
| 2009/0068578 | A1* | 3/2009 | Murakami | G03G 9/0808 430/105 |
| 2010/0035171 | A1 | 2/2010 | Watanabe et al. | |
| 2012/0045717 | A1 | 2/2012 | Hiroko et al. | |
| 2014/0349232 | A1 | 11/2014 | Kinumatsu et al. | |
| 2014/0356779 | A1 | 12/2014 | Hasegawa et al. | |
| 2015/0099222 | A1 | 4/2015 | Terui | |
| 2015/0153666 | A1 | 6/2015 | Isono et al. | |
| 2015/0153667 | A1 | 6/2015 | Noji et al. | |
| 2015/0153668 | A1 | 6/2015 | Tanaka et al. | |
| 2015/0153669 | A1 | 6/2015 | Yoshida et al. | |
| 2015/0153670 | A1 | 6/2015 | Shimano et al. | |
| 2015/0261110 | A1 | 9/2015 | Nakagawa et al. | |
| 2015/0331344 | A1 | 11/2015 | Tominaga et al. | |
| 2015/0370189 | A1 | 12/2015 | Tanaka et al. | |

FOREIGN PATENT DOCUMENTS

| | | | | |
|---|---|---|---|---|
| CN | 102654736 | | 9/2012 | |
| JP | 2006-301064 | | 11/2006 | |
| JP | 2008-224976 | * | 9/2008 | G03G 9/087 |
| JP | 2011-053494 | | 3/2011 | |
| JP | 2012-053196 | | 3/2012 | |
| JP | 2015-004868 | | 1/2015 | |

OTHER PUBLICATIONS

Translation of JP 2008-224976 published Sep. 2008.*
U.S. Appl. No. 15/154,802, filed May 13, 2016, Masatake Tanaka.
Jenkins, et al., "Glossary of Basic Terms in Polymer Science", Pure & Appl. Chem., vol. 68, No. 12 (1996) 2287-2311.

* cited by examiner

*Primary Examiner* — Peter L Vajda
(74) *Attorney, Agent, or Firm* — Fitzpatrick Cella Harper and Scinto

(57) ABSTRACT

Provided is a toner including a toner particle containing a graft polymer, in which: the graft polymer has a crystalline polyester segment and an amorphous vinyl polymer segment; the crystalline polyester segment has a unit derived from a specific monomer (a) and a unit derived from a specific monomer (b); a content X (mol %) of the unit derived from the monomer (b) calculated from a specific formula is 1.0 mol % or more and 24 mol % or less; and a melting point of the graft polymer is 50° C. or more and 85° C. or less.

10 Claims, No Drawings

TONER AND PRODUCTION METHOD THEREOF

BACKGROUND OF THE INVENTION

Field of the Invention

The present invention relates to a toner to be used in image-forming methods, such as an electrophotographic method, an electrostatic recording method, and a toner jet method, as well as relates to a production method of the toner.

Description of the Related Art

In recent years, an increase in speed and a reduction in power consumption have been required in a printer or a copying machine, and hence the development of a toner that achieves both heat-resistant storage stability and low-temperature fixability has been required. To cope with the requirements, many toners each using a binder resin containing a crystalline resin have been investigated. The crystalline resin shows high viscoelasticity as a solid in a temperature range lower than its melting point, and is abruptly reduced in viscoelasticity at temperatures exceeding the melting point, and hence the achievement of both the heat-resistant storage stability and the low-temperature fixability can be expected from the resin by utilizing the property.

However, the toner using the binder resin containing the crystalline resin is poor in affinity between the crystalline resin and any other binder resin component, and hence the dispersibility of the crystalline resin in the binder resin becomes insufficient and satisfactory low-temperature fixability is not obtained.

To cope with the problem, in each of Japanese Patent Application Laid-Open No. 2011-53494 and Chinese Patent Publication No. 102654736, there is a disclosure that the use of a crystalline resin formed of a composite resin containing a specific condensation polymerization-based resin and a styrene-based resin improves the dispersibility of the crystalline resin in the binder resin and hence improves the low-temperature fixability.

SUMMARY OF THE INVENTION

The inventors of the present invention have made an investigation, and as a result, have found that the toner disclosed in each of Japanese Patent Application Laid-Open No. 2011-53494 and Chinese Patent Publication No. 102654736 is improved in low-temperature fixability, but involves a problem in that the crystallinity of the crystalline resin is reduced by the compositing with the styrene-based resin, and hence the toner is reduced in heat-resistant storage stability and durability.

The present invention is directed to providing a toner that achieves both of low-temperature fixability, and heat-resistant storage stability and durability at higher levels.

According to one embodiment of the present invention, there is provided a toner, including a toner particle containing a binder resin, in which the binder resin comprises a graft polymer having:

(i) an amorphous vinyl polymer segment, and a crystalline polyester segment branched from the amorphous vinyl polymer segment; or (ii) a crystalline polyester segment, and an amorphous vinyl polymer segment branched from the crystalline polyester segment;

the crystalline polyester segment has a unit derived from a monomer (a) and a unit derived from a monomer (b), the monomer (a) is one or more selected from the group consisting of the monomer group A described below; and the monomer (b) is one or more selected from the group consisting of the monomer group B described below;

the crystalline polyester segment has a content X (mol %) of the unit derived from the monomer (b), as calculated from the following formula (1), of 1.0 mol % or more and 24 mol % or less:

$$X=\{Mb/(Ma+Mb)\}\times 100 \quad (1)$$

where:

Ma (mol/g) is the number of moles of the unit derived from the monomer (a) per unit mass; and Mb (mol/g) is the number of moles of the unit derived from the monomer (b) per unit mass, and a melting point of the graft polymer is 50° C. or more and 85° C. or less:

monomer group A:

an α,ω-straight-chain aliphatic diol having 2 or more and 11 or less carbon atoms;

an α,ω-straight-chain aliphatic dicarboxylic acid having 2 or more and 13 or less carbon atoms;

an α,ω-straight-chain aliphatic monohydroxymonocarboxylic acid having 2 or more and 12 or less carbon atoms;

an intramolecular acid anhydride of an α,ω-straight-chain aliphatic dicarboxylic acid having 2 or more and 13 or less carbon atoms;

an alkyl ester of an α,ω-straight-chain aliphatic dicarboxylic acid having 2 or more and 13 or less carbon atoms;

an alkyl ester of an α,ω-straight-chain aliphatic monohydroxymonocarboxylic acid having 2 or more and 12 or less carbon atoms; and a lactonized compound of an α,ω-straight-chain aliphatic monohydroxymonocarboxylic acid having 2 or more and 12 or less carbon atoms, monomer group B:

an α,ω-straight-chain aliphatic diol having 12 or more and 22 or less carbon atoms;

an α,ω-straight-chain aliphatic dicarboxylic acid having 14 or more and 24 or less carbon atoms;

an α,ω-straight-chain aliphatic monohydroxymonocarboxylic acid having 13 or more and 23 or less carbon atoms;

an intramolecular acid anhydride of an α,ω-straight-chain aliphatic dicarboxylic acid having 14 or more and 24 or less carbon atoms;

an alkyl ester of an α,ω-straight-chain aliphatic dicarboxylic acid having 14 or more and 24 or less carbon atoms;

an alkyl ester of an α,ω-straight-chain aliphatic monohydroxymonocarboxylic acid having 13 or more and 23 or less carbon atoms; and a lactonized compound of an α,ω-straight-chain aliphatic monohydroxymonocarboxylic acid having 13 or more and 23 or less carbon atoms.

Further features of the present invention will become apparent from the following description of exemplary embodiments.

DESCRIPTION OF THE EMBODIMENTS

A toner of the present invention is described in more detail below.

The inventors of the present invention have made extensive investigations for solving the problem, and as a result, have found that a toner that achieves both of low-temperature fixability, and heat-resistant storage stability and durability at higher levels is obtained when the toner includes a toner particle containing a binder resin including a graft polymer having a specific structure. Thus, the inventors have reached the present invention.

That is, a toner according to one embodiment of the present invention is a toner, including a toner particle containing a binder resin, in which:

[I] the binder resin comprises a graft polymer having:

(i) an amorphous vinyl polymer segment, and a crystalline polyester segment branched from the amorphous vinyl polymer segment; or (ii) a crystalline polyester segment, and an amorphous vinyl polymer segment branched from the crystalline polyester segment.

The crystalline polyester segment includes a unit derived from a monomer (a) and a unit derived from a monomer (b), the monomer (a) is one or more selected from the group consisting of the following monomer group A; and the monomer (b) is one or more selected from the group consisting of the following monomer group B.

The crystalline polyester segment has a content X (mol %) of the unit derived from the monomer (b), as calculated from the following formula (1), of 1.0 mol % or more and 24 mol % or less.

$$X=\{Mb/(Ma+Mb)\}\times 100 \quad (1)$$

(In the formula (1): Ma (mol/g) represents the number of moles of the unit derived from the monomer (a) per unit mass; and Mb (mol/g) represents the number of moles of the unit derived from the monomer (b) per unit mass.)

[Monomer Group A:

an α,ω-straight-chain aliphatic diol having 2 or more and 11 or less carbon atoms;

an α,ω-straight-chain aliphatic dicarboxylic acid having 2 or more and 13 or less carbon atoms;

an α,ω-straight-chain aliphatic monohydroxymonocarboxylic acid having 2 or more and 12 or less carbon atoms;

an intramolecular acid anhydride of an α,ω-straight-chain aliphatic dicarboxylic acid having 2 or more and 13 or less carbon atoms;

an alkyl ester of an α,ω-straight-chain aliphatic dicarboxylic acid having 2 or more and 13 or less carbon atoms;

an alkyl ester of an α,ω-straight-chain aliphatic monohydroxymonocarboxylic acid having 2 or more and 12 or less carbon atoms; and a lactonized compound of an α,ω-straight-chain aliphatic monohydroxymonocarboxylic acid having 2 or more and 12 or less carbon atoms]

[Monomer Group B:

an α,ω-straight-chain aliphatic diol having 12 or more and 22 or less carbon atoms;

an α,ω-straight-chain aliphatic dicarboxylic acid having 14 or more and 24 or less carbon atoms;

an α,ω-straight-chain aliphatic monohydroxymonocarboxylic acid having 13 or more and 23 or less carbon atoms;

an intramolecular acid anhydride of an α,ω-straight-chain aliphatic dicarboxylic acid having 14 or more and 24 or less carbon atoms;

an alkyl ester of an α,ω-straight-chain aliphatic dicarboxylic acid having 14 or more and 24 or less carbon atoms;

an alkyl ester of an α,ω-straight-chain aliphatic monohydroxymonocarboxylic acid having 13 or more and 23 or less carbon atoms; and a lactonized compound of an α,ω-straight-chain aliphatic monohydroxymonocarboxylic acid having 13 or more and 23 or less carbon atoms]

[II] A melting point of the graft polymer is 50° C. or more and 85° C. or less.

The inventors of the present invention have considered the mechanism via which the toner of the present invention expresses the effect to be as described below.

A conventional graft polymer having a crystalline polyester segment and an amorphous vinyl polymer segment improves the dispersibility of the graft polymer in the binder resin to improve the low-temperature fixability. However, the crystallinity of the polymer is reduced by compositing the amorphous vinyl polymer, and the heat-resistant storage stability is reduced by partially plasticizing the binder. Further, the following reduction in durability resulting from the deteriorated toner reduced in mechanical strength occurs: a stripe-like image void (developing stripe) perpendicular to the longitudinal direction of a photosensitive drum occurs on an image.

In addition, in the conventional graft polymer, a crystalline polyester obtained by subjecting the monomer (a) having 11 or less methylene groups to a reaction is excellent in low-temperature fixability, but its crystallinity is low, and its heat-resistant storage stability and durability are also low. A crystalline polyester obtained by subjecting the monomer (b) having 12 or more methylene groups to a reaction has the following trade-off relationship: the polyester is poor in low-temperature fixability, though its crystallinity is high, and its heat-resistant storage stability and durability are also high. In addition, also in a crystalline polyester merely using the monomer (a) and the monomer (b) in combination, its low-temperature fixability and its heat-resistant storage stability and durability are similarly in a trade-off relationship.

The crystalline polyester segment in the present invention is a resin obtained by causing the monomer (a) and the monomer (b) to react with each other (resin having the unit derived from the monomer (a) and the unit derived from the monomer (b)). In addition, the content X (mol %) of the unit derived from the monomer (b) is 1.0 mol % or more and 24 mol % or less. Thus, both of the low-temperature fixability, and the heat-resistant storage stability and the durability can be achieved. This is probably because the presence of an alkylene chain having 12 or more methylene groups derived from the monomer (b) in the graft polymer expressed a nucleating action serving as the starting point of a crystal at the time of the crystallization of the graft polymer in the toner. Probably as a result of the foregoing, despite the fact that the main component of the crystalline polyester segment is the unit derived from the monomer (a), its crystallinity is drastically improved and hence the effect of the present invention is expressed. The content X (mol %) is calculated from the following formula (1) where the number of moles of the unit derived from the monomer (a) per unit mass is defined as Ma (mol/g), and the number of moles of the unit derived from the monomer (b) per unit mass is defined as Mb (mol/g). The phrase "per unit mass" means that the amount of all monomer units constituting the crystalline polyester segment is defined as 1 g.

$$X=\{Mb/(Ma+Mb)\}\times 100 \quad (1)$$

The definition of a graft polymer is as follows: a macromolecule with one or more species of blocks connected to the main chain as side chains, the side chains having constitutional (chemical structural) or configurational features that differ from those in the main chain (The Society of Polymer Science, Japan, "Glossary of Basic Terms in Polymer Science" by IUPAC Commission on Macromolecular Nomenclature). The present invention also follows the definition.

The graft polymer of the present invention has the amorphous vinyl polymer segment and the crystalline polyester segment branched from the amorphous vinyl polymer segment. Alternatively, the graft polymer has the crystalline polyester segment and the amorphous vinyl polymer segment branched from the crystalline polyester segment. The term "crystalline" of the crystalline polyester segment means that the segment has a clear endothermic peak in differential scanning calorimetry (DSC) to be described later. On the other hand, a resin that does not show any clear endothermic peak is interpreted as being amorphous.

Examples of the α,ω-straight-chain aliphatic diol having 2 or more and 11 or less carbon atoms in the monomer group A include ethylene glycol, propylene glycol, 1,4-butanediol, 1,5-pentanediol, 1,6-hexanediol, 1,7-heptanediol, 1,8-octanediol, 1,9-nonanediol, 1,10-decanediol, and 1,11-undecanediol. Those diols may be used as a mixture.

Examples of the α,ω-straight-chain aliphatic dicarboxylic acid having 2 or more and 13 or less carbon atoms in the monomer group A include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, and 1,11-undecanedicarboxylic acid. Those acids may be used as a mixture. Those acids may each be used in the form of a compound obtained by converting a carboxy group thereof into an intramolecular acid anhydride or of a compound obtained by converting the carboxy group into an alkyl ester in a reaction.

Examples of the α,ω-straight-chain aliphatic monohydroxymonocarboxylic acid having 2 or more and 12 or less carbon atoms in the monomer group A include hydroxyacetic acid, 3-hydroxypropionic acid, 4-hydroxybutanoic acid, 5-hydroxypentanoic acid, 6-hydroxyhexanoic acid, 7-hydroxyheptanoic acid, 8-hydroxyoctanoic acid, 9-hydroxynonanoic acid, 10-hydroxydecanoic acid, 11-hydroxyundecanoic acid, and 12-hydroxydodecanoic acid. Those acids may be used as a mixture. Those acids may each be used in the form of a lactonized compound of the compound or of an alkyl ester of the compound in a reaction.

The monomer group A is more preferably the α,ω-straight-chain aliphatic diol having 2 or more and 11 or less carbon atoms, the α,ω-straight-chain aliphatic dicarboxylic acid having 2 or more and 13 or less carbon atoms, or the α,ω-straight-chain aliphatic monohydroxymonocarboxylic acid having 2 or more and 12 or less carbon atoms.

Examples of the α,ω-straight-chain aliphatic diol having 12 or more and 22 or less carbon atoms in the monomer group B include 1,12-dodecanediol, 1,13-tridecanediol, 1,14-tetradecanediol, 1,15-pentadecanediol, 1,16-hexadecanediol, 1,17-heptadecanediol, 1,18-octadecanediol, 1,19-nonadecanediol, 1,20-icosanediol, 1,21-henicosanediol, and 1,22-docosanediol. Those diols may be used as a mixture.

Examples of the α,ω-straight-chain aliphatic dicarboxylic acid having 14 or more and 24 or less carbon atoms in the monomer group B include 1,12-dodecanedicarboxylic acid, 1,13-tridecanedicarboxylic acid, 1,14-tetradecanedicarboxylic acid, 1,15-pentadecanedicarboxylic acid, 1,16-hexadecanedicarboxylic acid, 1,17-heptadecanedicarboxylic acid, 1,18-octadecanedicarboxylic acid, 1,19-nonadecanedicarboxylic acid, 1,20-icosanedicarboxylic acid, 1,21-henicosanedicarboxylic acid, and 1,22-docosanedicarboxylic acid. Those acids may be used as a mixture. Those acids may each be used in the form of a compound obtained by converting a carboxy group thereof into an intramolecular acid anhydride or of a compound obtained by converting the carboxy group into an alkyl ester in a reaction.

Examples of the α,ω-straight-chain aliphatic monohydroxymonocarboxylic acid having 13 or more and 23 or less carbon atoms in the monomer group B include 13-hydroxytridecanoic acid, 14-hydroxytetradecanoic acid, 15-hydroxypentadecanoic acid, 16-hydroxyhexadecanoic acid, 17-hydroxyheptadecanoic acid, 18-hydroxyoctadecanoic acid, 19-hydroxynonadecanoic acid, 20-hydroxyicosanoic acid, 21-hydroxyhenicosanoic acid, 22-hydroxydocosanoic acid, and 23-hydroxytricosanoic acid. Those acids may be used as a mixture. Those acids may each be used in the form of a lactonized compound of the compound or of an alkyl ester of the compound in a reaction.

The monomer group B is more preferably the α,ω-straight-chain aliphatic diol having 12 or more and 22 or less carbon atoms, the α,ω-straight-chain aliphatic dicarboxylic acid having 14 or more and 24 or less carbon atoms, or the α,ω-straight-chain aliphatic monohydroxymonocarboxylic acid having 13 or more and 23 or less carbon atoms.

The case where the crystalline polyester segment is a terpolymer obtained by subjecting two kinds of the monomers (a) and one kind of the monomer (b), or one kind of the monomer (a) and two kinds of the monomers (b), to condensation polymerization is preferred in terms of: the fact that the terpolymer is excellent in low-temperature fixability; and the ease of availability of raw materials therefor.

The crystalline polyester segment in the graft polymer in the present invention may be obtained by further subjecting a monomer in addition to the monomers selected from the monomer group A and the monomer group B to a reaction to the extent that the object of the present invention is not impaired. Examples of the monomer include an aromatic dicarboxylic acid, a branched aliphatic dicarboxylic acid, a cyclic aliphatic dicarboxylic acid, an aromatic diol, a branched aliphatic diol, and a cyclic aliphatic diol. When the other monomer is added, the total content of the unit derived from the monomer (a) and the unit derived from the monomer (b) is preferably 80 mol % or more and 100 mol % or less, more preferably 90 mol % or more and 100 mol % or less, particularly preferably 95 mol % or more and 100 mol % or less with respect to all the monomer units constituting the crystalline polyester segment.

Specific examples of the aromatic dicarboxylic acid include phthalic acid, isophthalic acid, and terephthalic acid. Examples of the branched aliphatic dicarboxylic acid include dimethylmalonic acid, isopropylmalonic acid, diethylmalonic acid, 1-methylbutylmalonic acid, dipropylmalonic acid, and diisobutylmalonic acid.

Examples of the cyclic aliphatic dicarboxylic acid include 1,4-cyclohexanedicarboxylic acid and 1,3-adamantanedicarboxylic acid.

Examples of the aromatic diol include a 2,2-bis(4-hydroxyphenyl)propane-polyoxypropylene adduct and a 2,2-bis(4-hydroxyphenyl)propane-polyoxyethylene adduct.

Examples of the branched aliphatic diol include 3-methyl-1,3-butanediol, neopentyl glycol, pinacol, 2-ethyl-1,3-hexanediol, 2,2,4-trimethyl-1,3-pentanediol, and 3,5-dimethyl-2,4-docosanediol.

Examples of the cyclic aliphatic diol include 1,4-cyclohexanediol, 1,4-cyclohexanedimethanol, and 2,2-bis(4-hydroxycyclohexyl)propane.

In addition, a terminal-sealing agent may be used in the graft polymer to the extent that the object of the present invention is not impaired. The use of the terminal-sealing agent enables simple adjustment of, for example, the molecular weight, acid value, and hydroxyl value of the graft polymer. Examples of the terminal-sealing agent include a monovalent acid or a derivative thereof, and a monohydric alcohol.

Specific examples of the monovalent acid or the derivative thereof include acetic acid, propanoic acid, butanoic acid, pentanoic acid, hexanoic acid, heptanoic acid, octanoic acid, nonanoic acid, decanoic acid, benzoic acid, and acid anhydrides thereof.

Examples of the monohydric alcohol include methanol, ethanol, propanol, butanol, pentanol, hexanol, heptanol, octanol, nonanol, and decanol.

The content X of the unit (partial structure) derived from the monomer (b) is more preferably 3.0 mol % or more and 20 mol % or less, still more preferably 5.0 mol % or more and 15 mol % or less because the toner is excellent in low-temperature fixability and is more excellent in heat-resistant storage stability.

The content X can be controlled by the loading amounts of the raw materials at the time of the production of the crystalline polyester segment of the graft polymer.

In the present invention, the content of the graft polymer in the binder resin to be incorporated into the toner particle is preferably 1.0 mass % or more and 35 mass % or less, more preferably 5.0 mass % or more and 20 mass % or less with respect to the total mass of the binder resin. When the content of the graft polymer in the binder resin is 1.0 mass % or more (more preferably 5.0 mass % or more), the low-temperature fixability is further improved. Meanwhile, when the content of the graft polymer in the binder resin is 35 mass % or less, the mechanical strength of the toner hardly reduces, and hence its durability hardly reduces and an image failure, such as a developing stripe, hardly occurs.

The content of the graft polymer in the binder resin to be incorporated into the toner particle can be controlled by the loading amounts of the raw materials at the time of the production of the toner.

In the present invention, the mass ratio (C/A ratio) of the crystalline polyester segment to the amorphous vinyl polymer segment in the graft polymer is preferably 40/60 or more and 90/10 or less.

When the C/A ratio is 90/10 or less, the characteristics of the amorphous vinyl polymer segment are expressed more satisfactorily. In addition, the low-temperature fixability is improved by an improvement in dispersibility of the graft polymer in the toner particle at the time of the solidification of the toner, and the heat-resistant storage stability and the durability are also improved. Meanwhile, when the C/A ratio is 40/60 or more, the characteristics of the crystalline polyester segment are expressed more satisfactorily, and hence the low-temperature fixability is improved. The mass ratio (C/A ratio) of the crystalline polyester segment to the amorphous vinyl polymer segment in the graft polymer is more preferably 70/30 or more and 85/15 or less.

The C/A ratio can be controlled by the loading amounts of the raw materials at the time of the production of the graft polymer.

In the present invention, the weight-average molecular weight (Mw) of the amorphous vinyl polymer segment in the graft polymer is preferably 3,000 or more and 20,000 or less. When the weight-average molecular weight of the amorphous vinyl polymer segment is 3,000 or more, the durability of the toner is improved by an improvement in mechanical strength thereof. Meanwhile, when the weight-average molecular weight of the amorphous vinyl polymer segment is 20,000 or less, the low-temperature fixability is improved because a reduction in viscosity of the graft polymer itself at the time of its melting is large.

The weight-average molecular weight (Mw) of the amorphous vinyl polymer segment in the graft polymer can be controlled to fall within the range by, for example, the amount of an initiator, the timing at which the initiator is added, and a reaction temperature.

The amorphous vinyl polymer segment is preferably produced from one or two or more polymerizable monomers selected from the following group. Examples of the polymerizable monomer include: styrene-based polymerizable monomers, such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; and methacrylic polymerizable monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate. Of those, styrene is preferred from the viewpoints of the ease of availability of raw materials and the ease of production of the graft polymer.

In the present invention, the weight-average molecular weight (Mw) of the graft polymer is preferably 15,000 or more and 100,000 or less, more preferably 20,000 or more and 45,000 or less. When the weight-average molecular weight (Mw) of the graft polymer is 15,000 or more, the heat-resistant storage stability and the durability are improved because the crystallinity of the graft polymer is improved or the mechanical strength is improved. Meanwhile, when the weight-average molecular weight (Mw) of the graft polymer is 100,000 or less, the movement of a molecule of the graft polymer hardly becomes sluggish and the plasticizing effect of the graft polymer on the binder resin at the time of the melting of the toner is improved, and hence the low-temperature fixability is improved.

The weight-average molecular weight (Mw) of the graft polymer can be controlled to fall within the range by, for example, the amount of the initiator, the timing at which the initiator is added, and the reaction temperature.

The melting point of the graft polymer is 50° C. or more and 85° C. or less, and the melting point can be controlled to fall within the range by, for example, the monomers constituting the crystalline polyester segment, and the mass ratio (C/A ratio) of the crystalline polyester segment to the amorphous vinyl polymer segment in the graft polymer.

A polyester-based resin, a styrene-acrylic resin, or the like can be used as the binder resin in the present invention. Of those, a styrene-acrylic resin is preferred because the introduction of the unit derived from the monomer (b) improves an affinity between the resin and any other binder resin component, thereby further improving the low-temperature fixability.

In the present invention, a vinyl-based polymerizable monomer capable of radical polymerization can be used as a polymerizable monomer constituting the styrene-acrylic resin. A monofunctional polymerizable monomer or a polyfunctional polymerizable monomer can be used as the vinyl-based polymerizable monomer.

Examples of the monofunctional polymerizable monomers include: styrene derivatives, such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; and methacrylic polymerizable monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

Examples of the polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

One kind of the monofunctional polymerizable monomers is used alone, or two or more kinds thereof are used in combination. Alternatively, the monofunctional polymerizable monomer and the polyfunctional polymerizable monomer are used in combination. Alternatively, one kind of the polyfunctional polymerizable monomers is used alone, or two or more kinds thereof are used in combination. Of the polymerizable monomers, the following monomers are preferably used for producing the styrene-acrylic resin from the viewpoints of the developing characteristic and durability of the toner: one kind of styrene and the styrene derivatives is used alone, or two or more kinds thereof are mixed, and such monomer or monomer mixture is mixed with an acrylic polymerizable monomer.

In the present invention, a method of producing the toner particle is not particularly limited, but the toner particle is preferably obtained by a method of producing a toner particle involving granulating a polymerizable monomer composition in an aqueous medium like a suspension polymerization method, an emulsion polymerization method, or a suspension granulation method.

The method of producing the toner particle is described below by taking, as an example, the suspension polymerization method that is most suitable out of the methods of producing a toner particle to be used in the present invention.

The polymerizable monomer capable of forming the binder resin and a specific graft polymer, and as required, any other additive, such as a colorant or a wax, are uniformly dissolved or dispersed with a dispersing machine, such as a homogenizer, a ball mill, a colloid mill, or an ultrasonic dispersing machine, and the polymerization initiator is dissolved in the resultant. Thus, a polymerizable monomer composition is prepared. Next, the polymerizable monomer composition is suspended in an aqueous medium containing a dispersion stabilizer, and the suspension is polymerized. Thus, the toner particle is produced.

The polymerization initiator may be added simultaneously with the addition of the other additive to the polymerizable monomer, or may be mixed immediately before the suspension in the aqueous medium. In addition, the polymerization initiator dissolved in the polymerizable monomer or a solvent may be added immediately after granulation and before the initiation of the polymerization reaction.

In the case of a polymerization method involving using the aqueous medium like the suspension polymerization method, a polar resin is preferably added to the polymerizable monomer composition. The addition of the polar resin can accelerate the inclusion of the graft polymer and the wax.

When the polar resin is present in the polymerizable monomer composition suspended in the aqueous medium, the polar resin is unevenly distributed to the surface of the toner particle because the polar resin easily migrates to the vicinity of an interface between the aqueous medium and the polymerizable monomer composition by virtue of a difference in affinity for water between the resin and the composition. As a result, the toner particle has a core-shell structure.

In addition, when a resin having a high melting temperature is selected as the polar resin to be used in a shell, even in the case where such design that the binder resin is melted at lower temperatures for the purpose of low-temperature fixation is performed, the occurrence of blocking during the storage of the toner can be suppressed.

A polyester-based resin or a carboxy group-containing styrene-based resin is preferred as the polar resin. In the case where the polyester-based resin or the carboxy group-containing styrene-based resin is used as the polar resin, the lubricity of the resin itself can be expected when the resin is unevenly distributed to the surface of the toner particle to form the shell.

A resin obtained by subjecting an acid component monomer and an alcohol component monomer listed below to condensation polymerization can be used as the polyester-based resin serving as the polar resin. Examples of the acid component monomer include terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexanedicarboxylic acid, and trimellitic acid.

Examples of the alcohol component monomer include ethylene glycol, diethylene glycol, triethylene glycol, 1,2-propylene glycol, 1,3-propylene glycol, 1,4-butanediol, neopentyl glycol, an alkylene glycol and a polyalkylene glycol of 1,4-bis(hydroxymethyl)cyclohexane, bisphenol A, hydrogenated bisphenol, a bisphenol A-ethylene oxide adduct, a bisphenol A-propylene oxide adduct, glycerin, trimethylolpropane, and pentaerythritol.

The carboxy group-containing styrene-based resin serving as the polar resin is preferably, for example, a styrene-based acrylic acid copolymer, a styrene-based methacrylic acid copolymer, or a styrene-based maleic acid copolymer.

Of those, a styrene-acrylate-acrylic acid-based copolymer is particularly preferred because its charge quantity is easily controlled.

In addition, the carboxy group-containing styrene-based resin more preferably contains a monomer having a primary or secondary hydroxy group. Specific examples of the polymer composition can include a styrene-2-hydroxyethyl methacrylate-methacrylic acid-methyl methacrylate copolymer, a styrene-n-butyl acrylate-2-hydroxyethyl methacrylate-methacrylic acid-methyl methacrylate copolymer, and a styrene-α-methylstyrene-2-hydroxyethyl methacrylate-methacrylic acid-methyl methacrylate copolymer. The resin containing the monomer having a primary or secondary hydroxyl group has large polarity and more satisfactory long-term standing stability.

The content of the polar resin is preferably 1 part by mass or more and 20 parts by mass or less, more preferably 2 parts by mass or more and 10 parts by mass or less with respect to 100 parts by mass of the binder resin.

A known wax can be used in the present invention. Specific examples thereof include a petroleum-based wax typified by paraffin wax, microcrystalline wax, or petrolatum and a derivative thereof, a montan wax and a derivative thereof, a hydrocarbon wax based on the Fischer-Tropsch method and a derivative thereof, a polyolefin wax typified by polyethylene and a derivative thereof, and a natural wax typified by carnauba wax or candelilla wax and a derivative thereof, and the derivatives include an oxide, a block copolymer with a vinyl monomer, and a graft modified product thereof. In addition, specific examples thereof also include: an alcohol, such as a higher aliphatic alcohol; a fatty acid, such as stearic acid or palmitic acid, and an acid amide, an ester, and a ketone thereof; and hydrogenated castor oil and a derivative thereof, a vegetable wax, and an animal wax. One kind of those waxes may be used alone, or two or more kinds thereof may be used in combination.

Of those, a polyolefin, a hydrocarbon wax based on the Fischer-Tropsch method, or a petroleum-based wax is preferably used because the developability or transferability of the toner tends to be improved. An antioxidant may be added to any such wax to the extent that the chargeability of the toner is not affected. In addition, any such wax is preferably used in an amount of 1 part by mass or more and 30 parts by mass or less with respect to 100 parts by mass of the binder resin.

The melting point of the wax to be used in the present invention is preferably 30° C. or more and 120° C. or less, more preferably 60° C. or more and 100° C. or less.

When a wax showing such heat characteristic as described in the foregoing is used, a releasing effect is efficiently expressed and hence a sufficient fixing region is secured.

A known colorant can be used in the present invention. Examples of the colorant include the following organic pigments, organic dyes, and inorganic pigments.

As a cyan colorant, there are given, for example, a copper phthalocyanine compound and a derivative thereof, an anthraquinone compound, and a basic dye lake compound. A specific example thereof is C.I. Pigment Blue 1, 7, 15, 15:1, 15:2, 15:3, 15:4, 60, 62, or 66.

As a magenta colorant, there are given, for example, a condensed azo compound, a diketopyrrolopyrrole compound, an anthraquinone compound, a quinacridone compound, a basic dye lake compound, a naphthol compound, a benzimidazolone compound, a thioindigo compound, and a perylene compound. Specific examples thereof include C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, or 254 and C.I. Pigment Violet 19.

As a yellow colorant, there are given, for example, a condensed azo compound, an isoindolinone compound, an anthraquinone compound, an azo metal complex, a methine compound, and an allylamide compound. A specific example thereof is C.I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, or 194.

As a black colorant, there are given, for example, carbon black, and colorant toned to a black color with the yellow colorant, the magenta colorant, and the cyan colorant.

One kind of those colorant can be used alone, or two or more kinds thereof can be used as a mixture or in the state of a solid solution. The colorant to be used in the present invention is selected in terms of a hue angle, chroma, lightness, light fastness, OHP transparency, and dispersibility in the toner particle.

The colorant is preferably used in an amount of 1 part by mass or more and 20 parts by mass or less with respect to 100 parts by mass of the binder resin.

When the toner particle is obtained by using the suspension polymerization method, a colorant subjected to a hydrophobic treatment with a substance that does not inhibit polymerization is preferably used in consideration of the polymerization-inhibiting property and aqueous phase-migrating property of the colorant. A preferred method of subjecting a dye to the hydrophobic treatment is, for example, a method involving polymerizing the polymerizable monomer in the presence of such dye in advance to provide a colored polymer, and the resultant colored polymer is added to the polymerizable monomer composition.

In addition, the carbon black may be subjected to a treatment with a substance that reacts with a surface functional group of the carbon black (polyorganosiloxane) as well as the same hydrophobic treatment as that for the dye.

In the present invention, a charge control agent or a charge control resin may be used.

A known agent can be utilized as the charge control agent, and a charge control agent that has a fast triboelectric charging speed and can stably maintain a constant triboelectric charge quantity is particularly preferred. Further, when the toner particle is produced by the suspension polymerization method, a charge control agent that has a low polymerization-inhibiting property and is substantially free of any matter solubilized in the aqueous medium is particularly preferred.

The charge control agent comes in a charge control agent that controls the toner so that the toner may be negatively chargeable and a charge control agent that controls the toner so that the toner may be positively chargeable. Examples of the charge control agent that controls the toner so that the toner may be negatively chargeable include: a monoazo metal compound; an acetylacetone metal compound; aromatic oxycarboxylic acid-, aromatic dicarboxylic acid-, oxycarboxylic acid-, and dicarboxylic acid-based metal compounds; an aromatic oxycarboxylic acid and an aromatic monocarboxylic acid or polycarboxylic acid and a metal salt, an anhydride, and an ester thereof; a phenol derivative, such as bisphenol; a urea derivative; a metal-containing salicylic acid-based compound; a metal-containing naphthoic acid-based compound; a boron compound; a quaternary ammonium salt; a calixarene; and a charge control resin.

Examples of the charge control agent that controls the toner so that the toner may be positively chargeable include:

a guanidine compound; an imidazole compound; a quaternary ammonium salt, such as tributylbenzylammonium 1-hydroxy-4-naphthosulfonate or tetrabutylammonium tetrafluoroborate, an analog thereof, i.e., an onium salt, such as a phosphonium salt, and lake pigments thereof; a triphenylmethane dye and a lake pigment thereof (as a laking agent, there are given, for example, phosphotungstic acid, phosphomolybdic acid, phosphotungstomolybdic acid, tannic acid, lauric acid, gallic acid, a ferricyanide, and a ferrocyanide); metal salts of higher fatty acids; and charge control resins.

One kind of those charge control agents or charge control resins may be added alone, or two or more kinds thereof may be added in combination.

Of those charge control agents, a metal-containing salicylic acid-based compound is preferred, and it is particularly preferred that the metal be aluminum or zirconium.

The addition amount of the charge control agent or the charge control resin is preferably 0.01 part by mass or more and 20 parts by mass or less, more preferably 0.5 part by mass or more and 10 parts by mass or less with respect to 100 parts by mass of the binder resin.

Meanwhile, a polymer or a copolymer having a sulfonic acid group, a sulfonic acid salt group, or a sulfonate group can be used as the charge control resin. In particular, the polymer having a sulfonic acid group, a sulfonic acid salt group, or a sulfonate group contains a sulfonic acid group-containing acrylamide-based monomer or a sulfonic acid group-containing methacrylamide-based monomer at a copolymerization ratio of preferably 2.0 mass % or more, more preferably 5.0 mass % or more.

The charge control resin preferably has a glass transition temperature (Tg) of 35° C. or more and 90° C. or less, a peak molecular weight (Mp) of 10,000 or more and 30,000 or less, and a weight-average molecular weight (Mw) of 25,000 or more and 50,000 or less. The use of the resin can impart a preferred triboelectric charging characteristic to the toner particle without affecting the heat characteristic which the toner particle is required to have. Further, the charge control resin contains a sulfonic acid group. Accordingly, for example, the dispersibility of the charge control resin itself in the polymerizable monomer composition, or the dispersibility of the colorant or the like therein is improved, and hence the coloring power, transparency, and triboelectric charging characteristic of the toner can be further improved.

Examples of the polymerization initiator include an organic peroxide-based initiator and an azo-based polymerization initiator. Examples of the organic peroxide-based initiator include benzoyl peroxide, lauroyl peroxide, di-α-cumyl peroxide, 2,5-dimethyl-2,5-bis(benzoylperoxy) hexane, bis(4-t-butylcyclohexyl) peroxydicarbonate, 1,1-bis (t-butylperoxy)cyclododecane, t-butyl peroxymaleic acid, bis(t-butylperoxy) isophthalate, methyl ethyl ketone peroxide, tert-butyl peroxy-2-ethylhexanoate, diisopropyl peroxycarbonate, cumene hydroperoxide, 2,4-dichlorobenzoyl peroxide, and tert-butyl peroxypivalate.

Examples of the azo-based polymerization initiator include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobismethylbutyronitrile, and 2,2'-azobis-(methyl isobutyrate).

A redox-based initiator obtained by combining an oxidizing substance and a reducing substance can also be used as the polymerization initiator. Examples of the oxidizing substance include: hydrogen peroxide; inorganic peroxides, such as persulfates (a sodium salt, a potassium salt, and an ammonium salt); and oxidizing metal salts, such as a tetravalent cerium salt. Examples of the reducing substance include: reducing metal salts (a divalent iron salt, a monovalent copper salt, and a trivalent chromium salt); ammonia; lower amines (amines each having about 1 or more and 6 or less carbon atoms, such as methylamine and ethylamine); amino compounds, such as hydroxylamine; reducing sulfur compounds, such as sodium thiosulfate, sodium hydrosulfite, sodium hydrogen sulfite, sodium sulfite, and sodium formaldehyde sulfoxylate; lower alcohols (each having 1 or more and 6 or less carbon atoms); ascorbic acid or a salt thereof; and lower aldehydes (each having 1 or more and 6 or less carbon atoms).

The polymerization initiator is selected with reference to its 10-hour half-life temperature, and one kind of the polymerization initiators is utilized alone, or two or more kinds thereof are utilized as a mixture. The addition amount of the polymerization initiator, which varies depending on a target degree of polymerization, is generally 0.5 part by mass or more and 20 parts by mass or less with respect to 100 parts by mass of the polymerizable monomer.

In addition, a known chain transfer agent and a known polymerization inhibitor can be further added for controlling the degree of polymerization of the binder resin.

Various crosslinking agents can also be used when the polymerizable monomer is polymerized. Examples of the crosslinking agents include polyfunctional compounds, such as divinylbenzene, 4,4'-divinylbiphenyl, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate, and trimethylolpropane trimethacrylate.

A known dispersion stabilizer based on an inorganic compound and a known dispersion stabilizer based on an organic compound can each be used as the dispersion stabilizer to be used in preparing the aqueous medium. Examples of the dispersion stabilizer based on the inorganic compound include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. On the other hand, examples of the dispersion stabilizer based on the inorganic compound include polyvinyl alcohol, gelatin, sodium salts of methylcellulose, methylhydroxypropylcellulose, ethylcellulose, and carboxymethylcellulose, polyacrylic acid and a salt thereof, and starch. The dispersion stabilizer is preferably used in an amount of 0.2 part by mass or more and 20 parts by mass or less with respect to 100 parts by mass of the polymerizable monomer.

When the dispersion stabilizer based on the inorganic compound out of those dispersion stabilizers is used, a commercial dispersion stabilizer may be used as it is, or the inorganic compound may be produced in the aqueous medium for obtaining a dispersion stabilizer having a finer particle diameter. For example, tricalcium phosphate is obtained by mixing an aqueous solution of sodium phosphate and an aqueous solution of calcium chloride under high-speed stirring.

An external additive may be externally added to the toner particle for imparting various characteristics to the toner. An external additive for improving the flowability of the toner is, for example, inorganic fine particles, such as silica fine particles, titanium oxide fine particles, and double oxide fine particles thereof. Of the inorganic fine particles, silica fine particles and titanium oxide fine particles are preferred.

The toner of the present invention can be obtained by, for example, externally adding and mixing the inorganic fine particles to the toner particle to cause the inorganic fine particles to adhere to the surface of the toner particle. A known method needs only to be adopted as a method of externally adding the inorganic fine particles. For example, a method involving performing a mixing treatment with Mitsui Henschel Mixer (manufactured by Nippon Coke & Engineering Co., Ltd. (Mitsui Miike Chemical Engineering Machinery, Co., Ltd.)) is available.

Examples of the silica fine particles include: dry silica or fumed silica produced by the vapor phase oxidation of a silicon halide; and wet silica produced from water glass. The dry silica having a small number of silanol groups present on its surface and in the silica fine particles, and having small amounts of $Na_2O$ and $SO_3^{2}$ is preferred as the inorganic fine particles. In addition, the dry silica may be composite fine particles of silica and any other metal oxide by using a metal halide, such as aluminum chloride or titanium chloride, together with the silicon halide in a production process for the silica.

When the surfaces of the inorganic fine particles are subjected to a hydrophobic treatment with a treatment agent, the adjustment of the triboelectric charge quantity of the toner, an improvement in environmental stability thereof, and an improvement in flowability thereof under high temperature and high humidity can be achieved. Accordingly, the inorganic fine particles subjected to the hydrophobic treatment are preferably used. When the inorganic fine particles externally added to the toner absorbs moisture, the triboelectric charge quantity and flowability of the toner reduce, and hence a reduction in developability or transferability thereof is liable to occur.

Examples of the treatment agent for subjecting the inorganic fine particles to the hydrophobic treatment include an unmodified silicone varnish, various modified silicone varnishes, an unmodified silicone oil, various modified silicone oils, a silane compound, a silane coupling agent, and other organic silicon compounds, and an organic titanium compound. Of those, a silicone oil is preferred. One kind of those treatment agents may be used alone, or two or more kinds thereof may be used in combination.

The total addition amount of the inorganic fine particles is preferably 1 part by mass or more and 5 parts by mass or less, more preferably 1 part by mass or more and 2.5 parts by mass or less with respect to 100 parts by mass of the toner particles. The particle diameter of the external additive is preferably 1/10 or less of the average particle diameter of the toner particles in terms of the durability of the toner.

Methods of measuring various physical properties according to the present invention are described below.

<Method of Measuring Molecular Weight>

The weight-average molecular weight (Mw) of the graft polymer is measured by gel permeation chromatography (GPC) as described below.

First, the graft polymer is dissolved in tetrahydrofuran (THF) at room temperature. Then, the resultant solution is filtered with a solvent-resistant membrane filter "MyShoriDisk" (manufactured by Tosoh Corporation) having a pore diameter of 0.2 μm to provide a sample solution. The concentration of a THF-soluble component in the sample solution is adjusted to 0.8 mass %. Measurement is performed with the sample solution under the following conditions.

Apparatus: high-speed GPC apparatus "HLC-8220 GPC" [manufactured by Tosoh Corporation]
Column: twin of LF-604 [manufactured by Showa Denko K.K.]
Eluent: THF
Flow rate: 0.6 ml/min
Oven temperature: 40° C.
Sample injection amount: 0.020 ml In the calculation of the molecular weight of a sample, a molecular weight calibration curve prepared with standard polystyrene resins (such as product names "TSK standard polystyrenes F-850, F-450, F-288, F-128, F-80, F-40, F-20, F-10, F-4, F-2, F-1, A-5000, A-2500, A-1000, and A-500" manufactured by Tosoh Corporation) is used.

The measurement of the molecular weight of the vinyl polymer segment in the graft polymer is performed by, for example, separating the vinyl polymer segment after the hydrolysis of the crystalline polyester segment of the graft polymer.

A specific method therefor is as described below. 5.0 Milliliters of dioxane and 1.0 ml of a 10 mass % aqueous solution of potassium hydroxide are added to 30 mg of the graft polymer, and the crystalline polyester segment is hydrolyzed by shaking the mixture at a temperature of 70° C. for 6 hours. The amorphous vinyl polymer segment is extracted by dialysis or any one of the various kinds of chromatography and dried. Thus, the amorphous vinyl polymer segment is obtained. Any subsequent operation is performed as in the graft polymer.

<Method of measuring Mass Ratio (C/A Ratio) of Crystalline Polyester Segment to Amorphous Vinyl Polymer Segment in Graft Polymer>

The mass ratio (C/A ratio) of the crystalline polyester segment to the amorphous vinyl polymer segment in the graft polymer is measured by using nuclear magnetic resonance spectroscopy ($^1$H-NMR) [400 MHz, $CDCl_3$, room temperature (25° C.)].

Measuring apparatus: FT NMR apparatus JNM-EX400 (manufactured by JEOL Ltd.)
Measuring frequency: 400 MHz
Pulse condition: 5.0 μs
Frequency range: 10,500 Hz
Number of scans: 64 times The mass ratio (C/A ratio) of the crystalline polyester segment to the amorphous vinyl polymer segment is calculated from the resultant integrated value of the spectrum.

<Method of Measuring Melting Point>

The melting point (Tm) of the graft polymer is measured with a differential scanning calorimeter "Q1000" (manufactured by TA Instruments) in conformity with ASTM D3418-82.

The melting points of indium and zinc are used in the temperature correction of the detecting portion of the apparatus, and the heat of fusion of indium is used in the correction of a heat quantity.

Specifically, 5.00 mg of the graft polymer is precisely weighed and loaded into a pan made of aluminum. The measurement is performed by using an empty pan made of aluminum as a reference in the measurement temperature range of 30° C. or more and 200° C. or less at a rate of temperature increase of 10° C./min. In the measurement, the temperature of the graft polymer is increased to 200° C. once, is subsequently decreased to 30° C. at a rate of temperature decrease of 10° C./min, and is then increased again. The highest endothermic peak of a DSC curve in the temperature range of 30° C. or more and 200° C. or less in the second temperature increase process is defined as the melting point (Tm) in the DSC measurement of the graft polymer.

<Separation of Graft Polymer and Other Binder Resin from Toner>

The following method is desirably used as a method of separating the graft polymer and any other binder resin from the toner. The separation is performed by the following method, and the identification of respective physical properties, such as the identification of the structures of the graft polymer and the other binder resin, is performed.

(Separation of Binder Resin and Wax from Toner by Preparative Gel Permeation Chromatography (GPC))

The toner is dissolved in tetrahydrofuran (THF) and the solvent is removed from the resultant soluble matter by distillation under reduced pressure. Thus, the tetrahydrofuran (THF)-soluble component of the toner is obtained.

A solution of the resultant tetrahydrofuran (THF)-soluble component of the toner in chloroform is prepared, and a low-molecular weight component derived from the wax and a high-molecular weight component derived from the resin are fractionated with a preparative GPC apparatus. Preparative GPC apparatus: preparative HPLC Model LC-980 manufactured by Japan Analytical Industry Co., Ltd. Preparative columns: JAIGEL 3H and JAIGEL 5H (manufactured by Japan Analytical Industry Co., Ltd.)

Eluent: chloroform

Flow rate: 3.5 ml/min

Sample concentration: 25 mg/ml

Sample amount: 3.5 ml

After the high-molecular weight component derived from the resin has been fractionated, the solvent is removed by distillation under reduced pressure, and the residue is dried in an atmosphere at 90° C. under reduced pressure for 24 hours. The foregoing operation is repeated until about 100 mg of the resin component is obtained.

(Graft Polymer and Other Binder Resin)

500 Milliliters of acetone is added to 100 mg of the resin obtained by the foregoing operation, and the resin is completely dissolved by heating the mixture to 70° C. After that, the graft polymer is recrystallized by gradually cooling the mixture to 25° C. The resultant mixture is separated into the crystalline graft polymer and a filtrate by subjecting the graft polymer to suction filtration.

Next, the remaining binder resin is reprecipitated by gradually adding the separated filtrate to 500 ml of methanol. After that, the binder resin is removed with a suction filter.

The graft polymer and the other binder resin thus obtained are dried at 40° C. for 24 hours under reduced pressure.

<Identification of Structures of Graft Polymer and Other Binder Resin>

The structures of the graft polymer and the other binder resin are identified by using nuclear magnetic resonance spectroscopy ($^1$H-NMR) [400 MHz, $CDCl_3$, room temperature (25° C.)].

Measuring apparatus: FT NMR apparatus JNM-EX400 (manufactured by JEOL Ltd.)

Measuring frequency: 400 MHz

Pulse condition: 5.0 μs

Frequency range: 10,500 Hz

Number of scans: 64 times

<Measurement of Content X of Partial Structure derived from Monomer (b) in Crystalline Polyester Segment of Graft Polymer>

The content X of the partial structure derived from the monomer (b) in the crystalline polyester segment of the graft polymer is calculated from the integrated value of the nuclear magnetic resonance spectroscopy ($^1$H-NMR) spectrum of the graft polymer.

Measuring apparatus: FT NMR apparatus JNM-EX400 (manufactured by JEOL Ltd.)

Measuring frequency: 400 MHz

Pulse condition: 5.0 μs

Frequency range: 10,500 Hz

Number of scans: 64 times

<Measurement of Content of Graft Polymer in Binder Resin from Toner>

The content of the graft polymer is calculated from the integrated value of the nuclear magnetic resonance spectroscopy ($^1$H-NMR) spectrum of the toner based on the respective nuclear magnetic resonance spectroscopy ($^1$H-NMR) spectra of the graft polymer and the other binder resin.

Measuring apparatus: FT NMR apparatus JNM-EX400 (manufactured by JEOL Ltd.)

Measuring frequency: 400 MHz

Pulse condition: 5.0 μs

Frequency range: 10,500 Hz

Number of scans: 64 times

EXAMPLES

The present invention is described in more detail below by way of Examples, but the present invention is not limited to Examples described below.

<Production of Graft Polymer 1>

139 Parts by mass of 1,6-hexanediol selected from the monomer group A and 55.5 parts by mass of 1,12-dodecanediol selected from the monomer group B were loaded into a reaction vessel with a stirring machine, a temperature gauge, a nitrogen-introducing tube, a dehydration tube, and a decompression apparatus, and the mixture was heated to 170° C. A mixed solution of 100 parts by mass of styrene, 5.93 parts by mass of acrylic acid, and 7.42 parts by mass of dicumyl peroxide was dropped to the mixture over 1 hour. After the completion of the dropping, the resultant was further subjected to a reaction for 3 hours. After that, 303 parts by mass of 1,10-decanedicarboxylic acid selected from the monomer group A and titanium(IV) isopropoxide serving as an esterification catalyst whose amount was 0.25 mol % (1.97 parts by mass) with respect to all monomers producing a crystalline polyester were added to the resultant, and the mixture was subjected to a reaction at 160° C. for 3 hours. After that, the resultant was subjected to a reaction at 180° C. for 3 hours, and was subjected to a reaction at 180° C. and 8 kPa until a desired molecular weight was obtained. Thus, a graft polymer 1 was obtained. The physical properties of the resultant graft polymer 1 are shown in Table 2. The graft polymer 1 has an amorphous vinyl polymer segment containing units derived from styrene and acrylic acid, and a crystalline polyester segment containing units derived from the diols and the dicarboxylic acid, the segment being branched from acrylic acid.

<Production of Graft Polymers 2 to 7 and 12 to 23>

Graft polymers 2 to 7, and 12 to 23 were obtained in the same manner as in the production of the graft polymer 1 except that the raw materials were changed as shown in Table 1. The physical properties of the resultant graft polymers 2 to 7, and 12 to 23 are shown in Table 2. Those graft polymers each have an amorphous vinyl polymer segment containing units derived from styrene and acrylic acid, and a crystalline polyester segment containing units derived from the diols and the dicarboxylic acid, the segment being branched from acrylic acid.

<Production of Graft Polymer 8>

162 Parts by mass of 1,6-hexanediol and 347 parts by mass of 1,10-decanedicarboxylic acid serving as monomers selected from the monomer group A, 66.6 parts by mass of 1,12-dodecanediol serving as a monomer selected from the monomer group B, and titanium(IV) isopropoxide serving as an esterification catalyst whose amount was 0.25 mol % (1.95 parts by mass) with respect to all monomers producing a crystalline polyester were loaded into a reaction vessel with a stirring machine, a temperature gauge, a nitrogen-introducing tube, a dehydration tube, and a decompression apparatus, and the mixture was heated to 160° C. and subjected to a reaction for 3 hours. After that, 9.45 parts by mass of methacrylic acid was added to the resultant, and the mixture was subjected to a reaction at 160° C. for 3 hours. A mixed solution of 100 parts by mass of styrene and 29.7 parts by mass of dicumyl peroxide was dropped to the resultant over 1 hour. After the completion of the dropping, the mixture was subjected to a reaction for 1 hour. After that, the resultant was subjected to a reaction at 180° C. and 8 kPa until a desired molecular weight was obtained. Thus, a graft polymer 8 was obtained. The physical properties of the resultant graft polymer 8 are shown in Table 2. The graft polymer 8 has a crystalline polyester segment containing units derived from the diols and the dicarboxylic acid, and an amorphous vinyl polymer segment containing units derived from styrene and methacrylic acid, the segment being branched from diols (1,6-Hexanediol or 1,12-Dodecanediol) at a terminal of the crystalline polyester segment.

<Production of Graft Polymers 9 to 11>

Graft polymers 9 to 11 were obtained in the same manner as in the production of the graft polymer 8 except that the raw materials were changed as shown in Table 1. The physical properties of the resultant graft polymers 9 to 11 are shown in Table 2. Those graft polymers each have a crystalline polyester segment containing units derived from the diols and the dicarboxylic acid, and an amorphous vinyl polymer segment containing units derived from styrene and methacrylic acid, the segment being branched from diols (1,6-Hexanediol or 1,12-Dodecanediol) at a terminal of the crystalline polyester segment.

<Production of Polymer 1 for Binder Resin>

22.6 Parts by mass of terephthalic acid, 1.80 parts by mass of trimellitic anhydride, 75.6 parts by mass of polyoxypropylene(2.2)-2,2-bis(4-hydroxyphenyl)propane, and 0.200 part by mass of titanium dihydroxybis(triethanolaminate) were loaded into a reaction vessel with a stirring machine, a temperature gauge, a nitrogen-introducing tube, a dehydration tube, and a decompression apparatus, and the mixture was heated to 200° C., and was subjected to a reaction for 8 hours while nitrogen was introduced and produced water was removed. After that, the resultant was subjected to a reaction at 8 kPa until a desired molecular weight was obtained. Thus, a polymer 1 for a binder resin was synthesized. The weight-average molecular weight (Mw) of the resultant polymer 1 for a binder resin was 8,000.

<Production of Comparative Polymer 1>

194 Parts by mass of 1,9-nonanediol and 31.3 parts by mass of KALCOL 6870 (manufactured by Kao Corporation) were loaded into a reaction vessel with a stirring machine, a temperature gauge, a nitrogen-introducing tube, a dehydration tube, and a decompression apparatus, and the mixture was heated to 170° C. A mixed solution of 100 parts by mass of styrene, 6.44 parts by mass of acrylic acid, and 8.03 parts by mass of dicumyl peroxide was dropped to the mixture over 1 hour. After the completion of the dropping, the resultant was further subjected to a reaction for 1 hour. After that, 211 parts by mass of sebacic acid, 1.50 parts by mass of titanium(IV) isopropoxide, and 0.250 part by mass of tertiary butyl catechol were added to the resultant, and the mixture was subjected to a reaction at 180° C. for 10 hours. After that, 12.2 parts of trimellitic anhydride was added to the resultant, and the mixture was subjected to a reaction at 180° C. and 8 kPa until a desired molecular weight was obtained. Thus, a comparative polymer 1 was obtained. The physical properties of the resultant comparative polymer 1 are shown in Table 2.

<Production of Comparative Polymer 2>

50.0 Parts by mass of xylene was loaded into a reaction vessel with a stirring machine, a temperature gauge, a nitrogen-introducing tube, a dehydration tube, and a decompression apparatus, and was heated to 100° C. under a nitrogen atmosphere. A mixed solution of 60.0 parts by mass of methyl methacrylate, 5.00 parts by mass of 4-hydroxybutyl methacrylate, 35.0 parts by mass of isobutyl methacrylate, and 1.40 parts by mass of azobisisobutyronitrile was dropped to the xylene over 1 hour. After the completion of the dropping, the mixture was subjected to a reaction at 140° C. for 1 hour, and the solvent and the remaining monomers were removed at 140° C. and 8 kPa. Thus, a functional acrylate prepolymer was obtained. Its weight-average molecular weight (Mw) was 30,000.

100 Parts by mass of the functional acrylate prepolymer, 184 parts by mass of 1,10-decanedicarboxylic acid, 182 parts by mass of 1,12-dodecanediol, butyltris(2-ethylhexanoyloxy)tin(IV), and a phosphite were loaded into a reaction vessel with a stirring machine, a temperature gauge, a nitrogen-introducing tube, a dehydration tube, and a decompression apparatus, and the mixture was subjected to a reaction under a nitrogen atmosphere at 200° C. for 1 hour. After that, the resultant was subjected to a reaction at 230° C., and when theoretically 95% of condensed water was recovered, 50.0 parts by mass of terephthalic acid was added to the residue, and the mixture was subjected to a reaction at 250° C. for 2 hours. After that, the resultant was subjected to a reaction at 250° C. and 8 kPa until a desired molecular weight was obtained. Thus, a comparative polymer 2 was obtained. The physical properties of the resultant comparative polymer 2 are shown in Table 2.

TABLE 1

| | Crystalline polyester segment | | | | | | | |
|---|---|---|---|---|---|---|---|---|
| | Monomer group A | | Monomer group B | | Amorphous vinyl polymer segment | | | |
| | Monomer | Part(s) by mass | Monomer | Part(s) by mass | Monomer | Part(s) by mass | Initiator | Part(s) by mass |
| Graft polymer 1 | 1,10-Decanedicarboxylic acid | 303 | 1,12-Dodecanediol | 55.5 | Styrene | 100 | Dicumyl peroxide | 7.42 |
| | 1,6-Hexanediol | 139 | | | Acrylic acid | 5.93 | | |
| Graft polymer 2 | Sebacic acid | $1.39 \times 10^3$ | 1,12-Dodecanediol | 305 | Styrene | 100 | Dicumyl peroxide | 7.42 |
| | 1,6-Hexanediol | 720 | | | Acrylic acid | 5.93 | | |

TABLE 1-continued

| | Crystalline polyester segment | | | | Amorphous vinyl polymer segment | | | |
|---|---|---|---|---|---|---|---|---|
| | Monomer group A | | Monomer group B | | | | | |
| | Monomer | Part(s) by mass | Monomer | Part(s) by mass | Monomer | Part(s) by mass | Initiator | Part(s) by mass |
| Graft polymer 3 | Sebacic acid<br>1,9-Nonanediol | 566<br>404 | 1,12-Dodecanediol | 122 | Styrene<br>Acrylic acid | 100<br>5.93 | Dicumyl peroxide | 7.42 |
| Graft polymer 4 | Sebacic acid<br>1,10-Decanediol | 38.8<br>37.3 | 1,12-Dodecanediol | 9.44 | Styrene<br>Acrylic acid | 100<br>5.93 | Dicumyl peroxide | 7.42 |
| Graft polymer 5 | 1,10-Decanedicarboxylic acid<br>1,10-Decanediol | 32.9<br>29.2 | 1,12-Dodecanediol | 7.22 | Styrene<br>Acrylic acid | 100<br>5.93 | Dicumyl peroxide | 7.42 |
| Graft polymer 6 | 1,10-Decanedicarboxylic acid<br>1,6-Hexanediol | 253<br>152 | 15-Hydroxypentadecanoic acid | 70.9 | Styrene<br>Acrylic acid | 100<br>5.93 | Dicumyl peroxide | 7.42 |
| Graft polymer 7 | 1,10-Decanedicarboxylic acid<br>1,6-Hexanediol | 221<br>169 | 1,22-Docosanedicarboxylic acid | 109 | Styrene<br>Acrylic acid | 100<br>5.93 | Dicumyl peroxide | 7.42 |
| Graft polymer 8 | 1,10-Decanedicarboxylic acid<br>1,6-Hexanediol | 347<br>162 | 1,12-Dodecanediol | 66.6 | Styrene<br>Methacrylic acid | 100<br>9.45 | Dicumyl peroxide | 29.7 |
| Graft polymer 9 | 1,10-Decanedicarboxylic acid<br>1,6-Hexanediol | 341<br>152 | 1,12-Dodecanediol | 63.8 | Styrene<br>Methacrylic acid | 100<br>9.45 | Dicumyl peroxide | 19.8 |
| Graft polymer 10 | 1,10-Decanedicarboxylic acid<br>1,6-Hexanediol | 284<br>117 | 1,12-Dodecanediol | 63.8 | Styrene<br>Methacrylic acid | 100<br>7.09 | Dicumyl peroxide | 2.97 |
| Graft polymer 11 | 1,10-Decanedicarboxylic acid<br>1,6-Hexanediol | 284<br>117 | 1,12-Dodecanediol | 63.8 | Styrene<br>Methacrylic acid | 100<br>7.09 | Dicumyl peroxide | 2.72 |
| Graft polymer 12 | 1,10-Decanedicarboxylic acid<br>1,6-Hexanediol | 291<br>152 | 1,12-Dodecanediol | 55.5 | Styrene<br>Acrylic acid | 100<br>5.93 | Dicumyl peroxide | 7.42 |
| Graft polymer 13 | 1,10-Decanedicarboxylic acid<br>1,6-Hexanediol | 291<br>152 | 1,12-Dodecanediol | 55.5 | Styrene<br>Acrylic acid | 100<br>5.93 | Dicumyl peroxide | 7.42 |
| Graft polymer 14 | 1,10-Decanedicarboxylic acid<br>1,6-Hexanediol | 303<br>146 | 1,12-Dodecanediol | 55.5 | Styrene<br>Acrylic acid | 100<br>5.93 | Dicumyl peroxide | 7.42 |
| Graft polymer 15 | 1,10-Decanedicarboxylic acid<br>1,6-Hexanediol | 316<br>136 | 1,12-Dodecanediol | 55.5 | Styrene<br>Acrylic acid | 100<br>5.93 | Dicumyl peroxide | 7.42 |
| Graft polymer 16 | 1,10-Decanedicarboxylic acid<br>1,6-Hexanediol | 316<br>136 | 1,12-Dodecanediol | 55.5 | Styrene<br>Acrylic acid | 100<br>5.93 | Dicumyl peroxide | 7.42 |
| Graft polymer 17 | 10-Hydroxydecanoic acid | 413 | 15-Hydroxypentadecanoic acid | 63.8 | Styrene<br>Acrylic acid | 100<br>5.93 | Dicumyl peroxide | 7.42 |
| Graft polymer 18 | 1,10-Decanedicarboxylic acid<br>1,6-Hexanediol | 310<br>178 | 1,12-Dodecanediol | 5.55 | Styrene<br>Acrylic acid | 100<br>5.93 | Dicumyl peroxide | 7.42 |
| Graft polymer 19 | 1,10-Decanedicarboxylic acid<br>1,6-Hexanediol | 310<br>169 | 1,12-Dodecanediol | 17.2 | Styrene<br>Acrylic acid | 100<br>5.93 | Dicumyl peroxide | 7.42 |
| Graft polymer 20 | 1,10-Decanedicarboxylic acid<br>1,6-Hexanediol | 284<br>100 | 1,12-Dodecanediol | 105 | Styrene<br>Acrylic acid | 100<br>5.93 | Dicumyl peroxide | 7.42 |
| Graft polymer 21 | 1,10-Decanedicarboxylic acid<br>1,6-Hexanediol | 284<br>87.5 | 1,12-Dodecanediol | 133 | Styrene<br>Acrylic acid | 100<br>5.93 | Dicumyl peroxide | 7.42 |
| Graft polymer 22 | 1,10-Decanedicarboxylic acid<br>Ethylene glycol | 373<br>102 | 1,12-Dodecanediol | 34.4 | Styrene<br>Acrylic acid | 100<br>5.93 | Dicumyl peroxide | 7.42 |
| Graft polymer 23 | Sebacic acid<br>1,3-Propanediol | 344<br>132 | 1,12-Dodecanediol | 36.6 | Styrene<br>Acrylic acid | 100<br>5.93 | Dicumyl peroxide | 7.42 |

45

TABLE 2

| | Content of | | Graft polymer | | |
|---|---|---|---|---|---|
| Polymer | unit derived from monomer (b) X [mol %] | Mw of amorphous vinyl polymer segment | Mass ratio (polyester segment/vinyl polymer segment) | Mw | Melting point [° C.] |
| Graft polymer 1 | 10 | 8,000 | 80/20 | 25,000 | 64 |
| Graft polymer 2 | 10 | 8,000 | 95/5.0 | 25,000 | 60 |
| Graft polymer 3 | 10 | 8,000 | 90/10 | 25,000 | 62 |
| Graft polymer 4 | 10 | 8,000 | 40/60 | 25,000 | 65 |
| Graft polymer 5 | 10 | 8,000 | 35/65 | 25,000 | 69 |
| Graft polymer 6 | 10 | 8,000 | 80/20 | 25,000 | 64 |
| Graft polymer 7 | 10 | 8,000 | 80/20 | 25,000 | 64 |
| Graft polymer 8 | 10 | 2,000 | 80/20 | 25,000 | 64 |
| Graft polymer 9 | 10 | 3,000 | 80/20 | 25,000 | 64 |
| Graft polymer 10 | 10 | 20,000 | 80/20 | 25,000 | 63 |
| Graft polymer 11 | 10 | 22,000 | 80/20 | 25,000 | 63 |
| Graft polymer 12 | 10 | 8,000 | 80/20 | 14,000 | 62 |
| Graft polymer 13 | 10 | 8,000 | 80/20 | 15,000 | 62 |
| Graft polymer 14 | 10 | 8,000 | 80/20 | 45,000 | 65 |

TABLE 2-continued

| Polymer | Content of unit derived from monomer (b) X [mol %] | Mw of amorphous vinyl polymer segment | Graft polymer: Mass ratio (polyester segment/vinyl polymer segment) | Graft polymer: Mw | Graft polymer: Melting point [° C.] |
|---|---|---|---|---|---|
| Graft polymer 15 | 10 | 8,000 | 80/20 | 100,000 | 66 |
| Graft polymer 16 | 10 | 8,000 | 80/20 | 120,000 | 66 |
| Graft polymer 17 | 10 | 8,000 | 80/20 | 25,000 | 75 |
| Graft polymer 18 | 1.0 | 8,000 | 80/20 | 25,000 | 65 |
| Graft polymer 19 | 3.0 | 8,000 | 80/20 | 25,000 | 64 |
| Graft polymer 20 | 20 | 8,000 | 80/20 | 25,000 | 65 |
| Graft polymer 21 | 24 | 8,000 | 80/20 | 25,000 | 65 |
| Graft polymer 22 | 5.0 | 8,000 | 80/20 | 25,000 | 82 |
| Graft polymer 23 | 5.0 | 8,000 | 80/20 | 25,000 | 52 |
| Comparative polymer 1 | 0 | 8,000 | 80/20 | 30,000 | 64 |
| Comparative polymer 2 | 53 | 30,000 | 77/23 | 100,000 | 75 |

<Production of Toner 1>

9.00 Parts by mass of tricalcium phosphate was added to $1.30\times10^3$ parts by mass of ion-exchanged water warmed to a temperature of 60° C., and the mixture was stirred with T.K. HOMOMIXER (manufactured by PRIMIX Corporation (Tokushu Kika Kogyo Co., Ltd.)) at a stirring speed of 15,000 rpm to prepare an aqueous medium.

In addition, the following binder resin materials were mixed while being stirred with a propeller-type stirring apparatus at a stirring speed of 100 rpm. Thus, a dissolved liquid was prepared.

| | |
|---|---|
| Styrene | 70.0 parts by mass |
| n-Butyl acrylate | 20.0 parts by mass |
| Graft polymer 1 | 10.0 parts by mass |

Next, the following materials were added to the dissolved liquid.

| | |
|---|---|
| Cyan colorant (C.I. Pigment Blue 15:3) | 6.50 parts by mass |
| Negative charge control agent (BONTRON E-84, manufactured by Orient Chemical Industries Co., Ltd.) | 0.500 part by mass |
| Hydrocarbon wax (melting point = 78° C.) | 9.00 parts by mass |
| Negative charge control resin 1 (Styrene/2-ethylhexyl acrylate/2-acrylamido-2-methylpropanesulfonic acid copolymer, acid value: 14.5 mgKOH/g, Tg = 83° C., Mw = 33,000) | 0.700 part by mass |
| Polar resin (Styrene/2-hydroxyethyl methacrylate/methacrylic acid/methyl methacrylate copolymer, acid value: 10 mgKOH/g, Tg = 80° C., Mw = 15,000) | 5.00 parts by mass |

After that, the mixed liquid was warmed to a temperature of 65° C., and then the materials were dissolved and dispersed in the dissolved liquid by stirring the mixed liquid with T.K. HOMOMIXER at a stirring speed of 10,000 rpm. Thus, a polymerizable monomer composition was prepared.

Subsequently, the polymerizable monomer composition was loaded into the aqueous medium, 6.00 parts by mass of PERBUTYL PV (10-hour half-life temperature: 54.6° C. (manufactured by NOF Corporation (Nippon Oil & Fats Co., Ltd.))) was added as a polymerization initiator to the mixture, and the whole was granulated by being stirred with T.K. HOMOMIXER at a temperature of 70° C. and a stirring speed of 15,000 rpm for 20 minutes.

The resultant was transferred to a propeller-type stirring apparatus and stirred at a stirring speed of 200 rpm. During the stirring, styrene and n-butyl acrylate serving as polymerizable monomers in the polymerizable monomer composition were subjected to a polymerization reaction at a temperature of 85° C. for 5 hours to produce a slurry containing toner particles. After the completion of the polymerization reaction, the slurry was cooled. Hydrochloric acid was added to the cooled slurry to adjust its pH to 1.4, and the calcium phosphate salt was dissolved by stirring the mixture for 1 hour. After that, the resultant was washed with water whose amount was 10 times as large as that of the slurry, filtered, and dried, followed by classification to adjust particle diameters. Thus, the toner particles were obtained. The toner particles contained 90.0 parts by mass of a styrene-acrylic resin, 10.0 parts by mass of the graft polymer, 6.50 parts by mass of the cyan colorant, 9.00 parts by mass of the wax, 0.500 part by mass of the negative charge control agent, 0.700 part by mass of the negative charge control resin 1, and 5.00 parts by mass of the polar resin.

1.50 Parts by mass of hydrophobic silica fine particles (primary particle diameter: 7 nm, BET specific surface area: 130 $m^2/g$) treated with 20 mass % of a dimethyl silicone oil with respect to the silica fine particles were mixed as an external additive into 100 parts by mass of the toner particles by using Mitsui Henschel Mixer (manufactured by Nippon Coke & Engineering Co., Ltd. (Mitsui Miike Chemical Engineering Machinery, Co., Ltd.)) at a stirring speed of 3,000 rpm for 15 minutes. Thus, a toner 1 was obtained. The physical properties of the toner are shown in Table 3. Dl represents a number-average particle diameter and D4 represents a weight-average particle diameter. The differential scanning calorimetry of the resultant toner 1 showed that the toner had an endothermic peak derived from a crystalline polyester.

<Production of Toners 2 to 26>

Toners 2 to 26 were obtained by the same production method as that for the toner 1 except that the raw materials and their addition numbers of parts were changed as shown in Table 3. The physical properties of the toners 2 to 26 are shown in Table 3. The differential scanning calorimetry of each of the resultant toners 2 to 26 showed that the toner had an endothermic peak derived from a crystalline polyester.

TABLE 3

| Toner | Binder resin: Graft polymer | Part(s) by mass | Styrene-acrylic resin | Part(s) by mass | D1 (μm) | D4 (μm) | Mw |
|---|---|---|---|---|---|---|---|
| Toner 1 | Graft polymer 1 | 10.0 | Styrene:n-butyl acrylate 78:22 | 90.0 | 4.7 | 5.7 | 28,000 |
| Toner 2 | Graft polymer 2 | 10.0 | Styrene:n-butyl acrylate 78:22 | 90.0 | 4.8 | 5.8 | 29,000 |
| Toner 3 | Graft polymer 3 | 10.0 | Styrene:n-butyl acrylate 78:22 | 90.0 | 4.7 | 5.7 | 27,000 |
| Toner 4 | Graft polymer 4 | 10.0 | Styrene:n-butyl acrylate 78:22 | 90.0 | 4.3 | 5.8 | 27,000 |
| Toner 5 | Graft polymer 5 | 10.0 | Styrene:n-butyl acrylate 78:22 | 90.0 | 4.7 | 5.7 | 29,000 |
| Toner 6 | Graft polymer 6 | 10.0 | Styrene:n-butyl acrylate 78:22 | 90.0 | 4.8 | 5.8 | 27,000 |
| Toner 7 | Graft polymer 7 | 10.0 | Styrene:n-butyl acrylate 78:22 | 90.0 | 4.7 | 5.8 | 29,000 |
| Toner 8 | Graft polymer 1 | 1.00 | Styrene:n-butyl acrylate 78:22 | 99.0 | 4.3 | 5.8 | 28,000 |
| Toner 9 | Graft polymer 1 | 35.0 | Styrene:n-butyl acrylate 78:22 | 65.0 | 4.7 | 5.7 | 28,000 |
| Toner 10 | Graft polymer 1 | 40.0 | Styrene:n-butyl acrylate 78:22 | 60.0 | 4.9 | 5.8 | 29,000 |
| Toner 11 | Graft polymer 8 | 10.0 | Styrene:n-butyl acrylate 78:22 | 90.0 | 4.3 | 5.7 | 27,000 |
| Toner 12 | Graft polymer 9 | 10.0 | Styrene:n-butyl acrylate 78:22 | 90.0 | 4.3 | 5.7 | 28,000 |
| Toner 13 | Graft polymer 10 | 10.0 | Styrene:n-butyl acrylate 78:22 | 90.0 | 4.9 | 5.9 | 27,000 |
| Toner 14 | Graft polymer 11 | 10.0 | Styrene:n-butyl acrylate 78:22 | 90.0 | 4.8 | 5.8 | 27,000 |
| Toner 15 | Graft polymer 12 | 10.0 | Styrene:n-butyl acrylate 78:22 | 90.0 | 4.8 | 5.8 | 31,000 |
| Toner 16 | Graft polymer 13 | 10.0 | Styrene:n-butyl acrylate 78:22 | 90.0 | 4.7 | 5.8 | 28,000 |
| Toner 17 | Graft polymer 14 | 10.0 | Styrene:n-butyl acrylate 78:22 | 90.0 | 4.8 | 5.8 | 28,000 |
| Toner 18 | Graft polymer 15 | 10.0 | Styrene:n-butyl acrylate 78:22 | 90.0 | 4.3 | 5.7 | 29,000 |
| Toner 19 | Graft polymer 16 | 10.0 | Styrene:n-butyl acrylate 78:22 | 90.0 | 4.7 | 5.9 | 31,000 |
| Toner 20 | Graft polymer 17 | 10.0 | Styrene:n-butyl acrylate 78:22 | 90.0 | 4.5 | 5.7 | 29,000 |
| Toner 21 | Graft polymer 18 | 10.0 | Styrene:n-butyl acrylate 78:22 | 90.0 | 4.3 | 5.7 | 27,000 |
| Toner 22 | Graft polymer 19 | 10.0 | Styrene:n-butyl acrylate 78:22 | 90.0 | 4.8 | 5.8 | 31,000 |
| Toner 23 | Graft polymer 20 | 10.0 | Styrene:n-butyl acrylate 78:22 | 90.0 | 4.3 | 6.1 | 29,000 |
| Toner 24 | Graft polymer 21 | 10.0 | Styrene:n-butyl acrylate 78:22 | 90.0 | 4.7 | 5.9 | 27,000 |
| Toner 25 | Graft polymer 22 | 10.0 | Styrene:n-butyl acrylate 78:22 | 90.0 | 4.8 | 5.8 | 27,000 |
| Toner 26 | Graft polymer 23 | 10.0 | Styrene:n-butyl acrylate 78:22 | 90.0 | 4.9 | 6.2 | 31,000 |

<Production of Toner 27>

The following materials were mixed in advance, and the mixture was melted and kneaded with a biaxial extruder. The kneaded product was cooled and pulverized with a hammer mill, and the resultant pulverized product was classified to provide toner particles.

| | |
|---|---|
| Binder resin [styrene-n-butyl acrylate copolymerized resin (Mw = 30,000, Tg = 58° C.)] | 90.0 parts by mass |
| Graft polymer 1 | 10.0 parts by mass |
| C.I. Pigment Blue 15:3 | 5.50 parts by mass |
| Metal compound of di-alkyl-salicylic acid [manufactured by Orient Chemical Industries Co., Ltd.: BONTRON E-84] | 3.00 parts by mass |
| Hydrocarbon wax (melting point = 78° C.) | 6.00 parts by mass |

1.50 Parts by mass of hydrophobic silica fine particles (primary particle diameter: 7 nm, BET specific surface area: 130 $m^2/g$) treated with 20 mass % of a dimethyl silicone oil with respect to the silica fine particles were mixed as an external additive into 100 parts by mass of the resultant toner particles by using Mitsui Henschel Mixer (manufactured by Nippon Coke & Engineering Co., Ltd. (Mitsui Miike Chemical Engineering Machinery, Co., Ltd.)) at a stirring speed of 3,000 rpm for 15 minutes. Thus, a toner 27 was obtained. The toner 27 had a Dl of 4.5 μm and a D4 of 5.9 μm.

<Production of Toner 28>

| (Preparation of Resin Particle Dispersion Liquid 1) | |
|---|---|
| Polymer 1 for binder resin | 100 parts by mass |
| NONIPOL 400 (manufactured by Sanyo Chemical Industries, Ltd.) | 1.50 parts by mass |

-continued

| (Preparation of Resin Particle Dispersion Liquid 1) | |
|---|---|
| NEOGEN SC (manufactured by DKS Co., Ltd.) | 2.20 parts by mass |
| Methyl ethyl ketone | 300 parts by mass |

The foregoing materials were mixed, and the mixture was heated and stirred at 60° C. so that the other three materials were dissolved in methyl ethyl ketone. 800 Parts by mass of ion-exchanged water was added to the solution, and then methyl ethyl ketone was removed by distillation at 50° C. or less. Thus, a resin particle dispersion liquid 1 obtained by dispersing resin particles having an average particle diameter of 0.28 μm was prepared.

| (Preparation of Resin Particle Dispersion Liquid 2) | |
|---|---|
| Graft polymer 1 | 100 parts by mass |
| NONIPOL 400 (manufactured by Sanyo Chemical Industries, Ltd.) | 1.50 parts by mass |
| NEOGEN SC (manufactured by DKS Co., Ltd.) | 2.20 parts by mass |
| Methyl ethyl ketone | 300 parts by mass |

The foregoing materials were mixed, and the mixture was heated and stirred at 60° C. so that the other three materials were dissolved in methyl ethyl ketone. 800 Parts by mass of ion-exchanged water was added to the solution, and then methyl ethyl ketone was removed by distillation at 50° C. or less. Thus, a resin particle dispersion liquid 2 obtained by dispersing resin particles having an average particle diameter of 0.36 μm was prepared.

| (Preparation of Colorant Particle Dispersion Liquid) | |
|---|---|
| Cyan colorant (C.I. Pigment Blue 15:3) | 20.0 parts by mass |
| NEOGEN SC (manufactured by DKS Co. Ltd.) | 3.00 parts by mass |
| Ion-exchanged water | 78.0 parts by mass |

The foregoing materials were mixed, and the other two materials were dispersed in the ion-exchanged water with a sand grinder mill. A particle size distribution in the colorant particle dispersion liquid was measured with a particle size-measuring apparatus (manufactured by Horiba, Ltd., LA-700). As a result, the average particle diameter of colorant particles in the dispersion liquid was 0.20 μm, and no coarse particle having a diameter of more than 1 μm was observed.

| (Preparation of Wax Particle Dispersion Liquid) | |
|---|---|
| Hydrocarbon wax (melting point = 78° C.) | 50.0 parts by mass |
| NEOGEN SC (manufactured by DKS Co. Ltd.) | 7.00 parts by mass |
| Ion-exchanged water | 200 parts by mass |

The foregoing materials were heated to a temperature of 95° C., and the other two materials were dispersed in the ion-exchanged water with a homogenizer (manufactured by IKA: ULTRA-TURRAX T50). After that, the resultant was subjected to a dispersion treatment with a pressure ejection-type homogenizer. Thus, a wax particle dispersion liquid obtained by dispersing the wax having an average particle diameter of 0.50 μm was prepared.

| (Preparation of Charge Control Particle Dispersion Liquid) | |
|---|---|
| Metal compound of di-alkyl-salicylic acid (negative charge control agent, BONTRON E-84, manufactured by Orient Chemical Industries Co., Ltd.) | 5.00 parts by mass |
| NEOGEN SC (manufactured by DKS Co., Ltd.) | 3.00 parts by mass |
| Ion-exchanged water | 78.0 parts by mass |

The foregoing materials were mixed, and the other two materials were dispersed in the ion-exchanged water with a sand grinder mill.

| (Preparation of Mixed Liquid) | |
|---|---|
| Resin particle dispersion liquid 1 | 810 parts by mass |
| Resin particle dispersion liquid 2 | 91.0 parts by mass |
| Colorant particle dispersion liquid | 28.0 parts by mass |
| Wax particle dispersion liquid | 47.0 parts by mass |

The foregoing materials were loaded into a 1-liter separable flask with a stirring apparatus, a condenser, and a temperature gauge, and were stirred. The pH of the mixed liquid was adjusted to 5.2 with a 1.0 mol/L potassium hydroxide.

120 Parts by mass of an 8.0% aqueous solution of sodium chloride was dropped as an aggregating agent to the mixed liquid, and the mixture was heated to a temperature of 55° C. while being stirred. 10.5 Parts by mass of the charge control particle dispersion liquid was added to the mixture at the temperature. After having been held at a temperature of 55° C. for 2 hours, the resultant was observed with an optical microscope. As a result, it was confirmed that aggregated particles having an average particle diameter of 3.2 μm were formed.

After that, 3.00 parts by mass of NEOGEN SC (manufactured by DKS Co., Ltd.) was added to the resultant. After that, while stirring was continued, the mixture was heated to a temperature of 95° C. and held at the temperature for 4.5 hours. Then, the mixture was cooled, and then the reaction product was filtered and sufficiently washed with ion-exchanged water. After that, fluidized bed drying was performed at a temperature of 45° C. Thus, toner particles were obtained. The toner particles contained 90.0 parts by mass of the polymer 1 for a binder resin, 10.0 parts by mass of the graft polymer, 5.50 parts by mass of the cyan colorant, 9.00 parts by mass of the wax, and 0.600 part by mass of the negative charge control agent.

1.50 Parts by mass of hydrophobic silica fine particles (primary particle diameter: 7 nm, BET specific surface area: 130 $m^2/g$) treated with 20 mass % of a dimethyl silicone oil with respect to the silica fine particles were mixed as an external additive into 100 parts by mass of the resultant toner particles by using Mitsui Henschel Mixer (manufactured by Nippon Coke & Engineering Co., Ltd. (Mitsui Miike Chemical Engineering Machinery, Co., Ltd.)) at a stirring speed of 3,000 rpm for 15 minutes. Thus, a toner 28 was obtained. The toner 28 had a Dl of 4.5 μm and a D4 of 6.1 μm.

<Production of Toner 29>

| | |
|---|---|
| Polymer 1 for binder resin | 90.0 parts by mass |
| Graft polymer 1 | 10.0 parts by mass |
| Methyl ethyl ketone | 100 parts by mass |
| Ethyl acetate | 100 parts by mass |

-continued

| | |
|---|---|
| Hydrocarbon wax (melting point = 78° C.) | 9.00 parts by mass |
| Cyan colorant (C.I. Pigment Blue 15:3) | 6.50 parts by mass |
| Negative charge control resin 1 (styrene/2-ethylhexyl acrylate/2-acrylamido-2-methylpropanesulfonic acid copolymer, acid value: 14.5 mgKOH/g, Tg = 83° C., Mw = 33,000) | 1.00 part by mass |

The foregoing materials were dispersed with an attritor (manufactured by Nippon Coke & Engineering Co., Ltd. (Mitsui Miike Chemical Engineering Machinery, Co., Ltd.)) for 3 hours to provide a colorant dispersion liquid.

Meanwhile, 27.0 parts by mass of calcium phosphate was added to 3,000.0 parts by mass of ion-exchanged water warmed to a temperature of 60° C., and the mixture was stirred with T.K. HOMOMIXER at a stirring speed of 10,000 rpm to prepare an aqueous medium. The colorant dispersion liquid was loaded into the aqueous medium, and the mixture was stirred at a temperature of 65° C. under a $N_2$ atmosphere with the T.K. HOMOMIXER at a stirring speed of 12,000 rpm for 15 minutes. Thus, colorant particles were produced. After that, the T.K. HOMOMIXER was changed to an ordinary propeller stirring apparatus, the stirring speed of the stirring apparatus was maintained at 150 rpm, and a temperature in the apparatus was increased to a temperature of 95° C. and held at the temperature for 3 hours, followed by the removal of the solvent from the dispersion liquid. Thus, a toner particle dispersion liquid was prepared.

Hydrochloric acid was added to the resultant toner particle dispersion liquid to adjust its pH to 1.4, and the calcium phosphate salt was dissolved by stirring the mixture for 1 hour. The dispersion liquid was filtered with a pressure filter and washed to provide a toner aggregate. After that, the toner aggregate was crushed and dried to provide toner particles. The toner particles contained 90.0 parts by mass of the polymer 1 for a binder resin, 10.0 parts by mass of the graft polymer, 6.50 parts by mass of the cyan colorant, 9.00 parts by mass of the wax, and 1.00 part by mass of the negative charge control resin 1.

1.50 Parts by mass of hydrophobic silica fine particles (primary particle diameter: 7 nm, BET specific surface area: 130 $m^2/g$) treated with 20 mass % of a dimethyl silicone oil with respect to the silica fine particles were mixed as an external additive into 100 parts by mass of the resultant toner particles by using Mitsui Henschel Mixer (manufactured by Nippon Coke & Engineering Co., Ltd. (Mitsui Miike Chemical Engineering Machinery, Co., Ltd.)) at a stirring speed of 3,000 rpm for 15 minutes. Thus, a toner 29 was obtained. The toner 29 had a Dl of 3.9 μm and a D4 of 6.3 μm.

<Production of Comparative Toner 1>

A comparative toner 1 was obtained by the same production method as that for the toner 1 except that in the production of the toner 1, the graft polymer 1 (10.0 parts by mass) was changed to the comparative polymer 1 (10.0 parts by mass). The comparative toner 1 had a Dl of 4.1 μm and a D4 of 5.8 μm.

<Production of Comparative Toner 2>

A comparative toner 2 was obtained by the same production method as that for the toner 1 except that in the production of the toner 1, the graft polymer 1 (10.0 parts by mass) was changed to the comparative polymer 2 (10.0 parts by mass). The comparative toner 2 had a Dl of 4.2 μm and a D4 of 5.8 μm.

<Toner Evaluation>

[Heat-resistant Storage Stability (Blocking)] 5 Grams of each of the toners was loaded into a 50-cubic centimeter polymer cup, and was left to stand at a temperature of 55° C. and a humidity of 10% RH for 3 days. Then, the toner was evaluated by examining the presence or absence of an aggregate. In the present invention, a level of C or higher is a level at which the effect of the present invention is obtained.

(Evaluation Criteria)

A: No aggregate occurs.

B: A slight aggregate occurs but collapses when lightly pushed with a finger.

C: An aggregate occurs and does not collapse even when lightly pushed with a finger.

D: The toner completely aggregates.

<Image Evaluations>

Image evaluations were performed after a commercial color laser printer [HP Color LaserJet 3525dn] had been partially reconstructed. The printer was reconstructed so as to operate even when only a process cartridge for one color was mounted thereon. In addition, the printer was reconstructed so that the temperature of its fixing unit could be changed to an arbitrary value.

A toner stored in a process cartridge for a black toner mounted on the color laser printer was removed from the cartridge, and the inside of the cartridge was cleaned by air blowing. After that, each of the toners (300 g) was introduced into the process cartridge, the process cartridge refilled with the toner was mounted on the color laser printer, and the following image evaluations were performed. Specific image evaluation items are as described below.

[Low-Temperature Fixability]

A solid image (toner laid-on level: 0.9 $mg/cm^2$) was transferred onto a transfer material, and the image was evaluated while a fixation temperature was changed. The fixation temperature is a value obtained by measuring the temperature of the surface of a fixing roller with a non-contact temperature gauge. Letter size plain paper (XEROX 4200 Paper, manufactured by Xerox Corporation, 75 $g/m^2$) was used as the transfer material. In the present invention, a level of D or higher is a level at which the effect of the present invention is obtained.

(Evaluation Criteria)

A: No offset occurs at 120° C.

B: An offset occurs at 120° C.

C: An offset occurs at 125° C.

D: An offset occurs at 130° C.

E: An offset occurs at 135° C.

[Durability]

The following printout test was performed under each of a normal-temperature and normal-humidity environment (having a temperature of 23° C. and a humidity of 60% RH), and a high-temperature and high-humidity environment (having a temperature of 33° C. and a humidity of 85% RH): a horizontal line image having a print percentage of 1% was printed out on 35,000 sheets of paper. After the completion of the test, a halftone image (toner laid-on level: 0.6 $mg/cm^2$) was printed out on letter size plain paper (XEROX 4200 Paper, manufactured by Xerox Corporation, 75 $g/m^2$), and the toner was evaluated for its durability based on the occurrence status of a developing stripe. In the present invention, a level of C or higher is a level at which the effect of the present invention is obtained.

(Evaluation Criteria)

A: No developing stripe occurs.

B: Developing stripes occur at 1 or more and 3 or less sites.

C: Developing stripes occur at 4 or more and 6 or less sites.
D: Developing stripes occur at 7 or more sites, or a developing stripe having a width of 0.5 mm or more occurs.

Examples 1 to 29

In Examples 1 to 29, the evaluations were performed by using the toners 1 to 29, respectively. The results of the evaluations are shown in Table 4.

Comparative Examples 1 and 2

In Comparative Examples 1 and 2, the evaluations were performed by using the comparative toners 1 and 2, respectively. The results of the evaluations are shown in Table 4.

TABLE 4

| Example | Toner | Low-temperature fixability | Blocking | Developing stripe |
|---|---|---|---|---|
| Example 1 | Toner 1 | A | A | A(0) |
| Example 2 | Toner 2 | B | A | C(4) |
| Example 3 | Toner 3 | A | A | B(1) |
| Example 4 | Toner 4 | C | A | A(0) |
| Example 5 | Toner 5 | D | A | A(0) |
| Example 6 | Toner 6 | A | A | A(0) |
| Example 7 | Toner 7 | A | A | A(0) |
| Example 8 | Toner 8 | C | A | A(0) |
| Example 9 | Toner 9 | A | B | B(1) |
| Example 10 | Toner 10 | A | B | C(4) |
| Example 11 | Toner 11 | A | A | C(4) |
| Example 12 | Toner 12 | B | A | B(2) |
| Example 13 | Toner 13 | B | A | A(0) |
| Example 14 | Toner 14 | C | A | A(0) |
| Example 15 | Toner 15 | A | C | C(4) |
| Example 16 | Toner 16 | A | B | B(2) |
| Example 17 | Toner 17 | B | A | A(0) |
| Example 18 | Toner 18 | C | A | A(0) |
| Example 19 | Toner 19 | D | A | A(0) |
| Example 20 | Toner 20 | C | A | A(0) |
| Example 21 | Toner 21 | A | C | A(0) |
| Example 22 | Toner 22 | A | B | A(0) |
| Example 23 | Toner 23 | A | A | A(0) |
| Example 24 | Toner 24 | C | A | A(0) |
| Example 25 | Toner 25 | B | A | A(0) |
| Example 26 | Toner 26 | A | C | B(2) |
| Example 27 | Toner 27 | A | B | C(6) |
| Example 28 | Toner 28 | A | C | C(6) |
| Example 29 | Toner 29 | A | C | C(5) |
| Comparative Example 1 | Comparative Toner 1 | C | D | D(4 mm) |
| Comparative Example 2 | Comparative Toner 2 | E | B | D(9) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-098778, filed May 14, 2015, which is hereby incorporated by reference herein in its entirety.

What is claimed is:

1. A toner, comprising a toner particle containing a binder resin, comprising:

a graft polymer having (i) an amorphous vinyl polymer segment and a crystalline polyester segment branched from the amorphous vinyl polymer segment, or (ii) a crystalline polyester segment and an amorphous vinyl polymer segment branched from the crystalline polyester segment;

the crystalline polyester segment comprising a unit derived from a monomer (a) and a unit derived from a monomer (b), monomer (a) being one or more monomers selected from the group consisting of a $C_{2-11}$ α,ω-straight-chain aliphatic diol, a $C_{2-13}$ α,ω-straight-chain aliphatic dicarboxylic acid, a $C_{2-12}$ α,ω-straight-chain aliphatic monohydroxymonocarboxylic acid, an intramolecular acid anhydride of a $C_{2-13}$ α,ω-straight-chain aliphatic dicarboxylic acid, an alkyl ester of a $C_{2-13}$ α,ω-straight-chain aliphatic dicarboxylic acid, an alkyl ester of a $C_{2-12}$ α,ω-straight-chain aliphatic monohydroxymonocarboxylic acid and a lactonized compound of a $C_{2-12}$ α,ω-straight-chain aliphatic monohydroxymonocarboxylic acid, and monomer (b) being one or more monomers selected from the group consisting of a $C_{12-22}$ α,ω-straight-chain aliphatic diol, a $C_{14-24}$ α,ω-straight-chain aliphatic dicarboxylic acid, a $C_{13-23}$ α,ω-straight-chain aliphatic monohydroxymonocarboxylic acid, an intramolecular acid anhydride of a $C_{14-24}$ α,ω-straight-chain aliphatic dicarboxylic acid, an alkyl ester of a $C_{14-24}$ α,ω-straight-chain aliphatic dicarboxylic acid, an alkyl ester of a $C_{13-23}$ α,ω-straight-chain aliphatic monohydroxymonocarboxylic acid and a lactonized compound of a $C_{13-23}$ α,ω-straight-chain aliphatic monohydroxymonocarboxylic acid, wherein the crystalline polyester segment has a content X (mol %) of the unit derived from the monomer (b) of 1.0 to 20 mol % as calculated from $X=\{Mb/(Ma+Mb)\}\times 100$ where Ma (mol/g) is the number of moles of the unit derived from the monomer (a) per unit mass, and Mb (mol/g) is the number of moles of the unit derived from the monomer (b) per unit mass, and a melting point of the graft polymer is 50 to 85° C.

2. A toner according to claim 1, wherein a content of the graft polymer is 1.0 to 35 mass % with respect to a total mass of the binder resin.

3. A toner according to claim 1, wherein a mass ratio (C/A ratio) of the crystalline polyester segment to the amorphous vinyl polymer segment in the graft polymer is 40/60 to 90/10.

4. A toner according to claim 1, wherein the amorphous vinyl polymer segment in the graft polymer has a weight-average molecular weight (Mw) of 3,000 to 20,000.

5. A toner according to claim 1, wherein the graft polymer has a weight-average molecular weight (Mw) of 15,000 to 100,000.

6. A toner according to claim 1, wherein the crystalline polyester segment is a terpolymer.

7. A toner according to claim 1, wherein the content X (mol %) of the unit derived from the monomer (b) is 3.0 to 20 mol %.

8. A toner according to claim 1, wherein the monomer group A is the $C_{2-11}$ α,ω-straight-chain aliphatic diol, the $C_{2-13}$ α,ω-straight-chain aliphatic dicarboxylic acid, or the $C_{2-12}$ α,ω-straight-chain aliphatic monohydroxymonocarboxylic acid, and the monomer group B is the $C_{12-22}$ α,ω-straight-chain aliphatic diol, the $C_{14-24}$ α,ω-straight-chain aliphatic dicarboxylic acid, or the $C_{13-23}$ α,ω-straight-chain aliphatic monohydroxymonocarboxylic acid.

9. A toner according to claim 1, wherein the binder resin further contains a styrene-acrylic resin.

10. A method of producing a toner, comprising the steps of:

granulating a polymerizable monomer composition containing a polymerizable monomer capable of forming the binder resin and a graft polymer in an aqueous medium to polymerize the polymerizable monomer composition, wherein the toner comprises a toner particle containing a binder resin, the binder resin comprising:

a graft polymer having (i) an amorphous vinyl polymer segment and a crystalline polyester segment branched from the amorphous vinyl polymer segment, or (ii) a crystalline polyester segment and an amorphous vinyl polymer segment branched from the crystalline polyester segment;

the crystalline polyester segment comprising a unit derived from a monomer (a) and a unit derived from a monomer (b), monomer (a) being one or more monomers selected from the group consisting of a $C_{2-11}$ α,ω-straight-chain aliphatic diol, a $C_{2-13}$ α,ω-straight-chain aliphatic dicarboxylic acid, a $C_{2-12}$ α,ω-straight-chain aliphatic monohydroxymonocarboxylic acid, an intramolecular acid anhydride of a $C_{2-13}$ α,ω-straight-chain aliphatic dicarboxylic acid, an alkyl ester of a $C_{2-13}$ α,ω-straight-chain aliphatic dicarboxylic acid, an alkyl ester of a $C_{2-12}$ α,ω-straight-chain aliphatic monohydroxymonocarboxylic acid and a lactonized compound of a $C_{2-12}$ α,ω-straight-chain aliphatic monohydroxymonocarboxylic acid, and monomer (b) being one or more monomers selected from the group consisting of a $C_{12-22}$ α,ω-straight-chain aliphatic diol, a $C_{14-24}$ α,ω-straight-chain aliphatic dicarboxylic acid, a $C_{13-23}$ α,ω-straight-chain aliphatic monohydroxymonocarboxylic acid, an intramolecular acid anhydride of a $C_{14-24}$ α,ω-straight-chain aliphatic dicarboxylic acid, an alkyl ester of a $C_{14-24}$ α,ω-straight-chain aliphatic dicarboxylic acid, an alkyl ester of a $C_{13-23}$ α,ω-straight-chain aliphatic monohydroxymonocarboxylic acid and a lactonized compound of a $C_{13-23}$ α,ω-straight-chain aliphatic monohydroxymonocarboxylic acid, wherein the crystalline polyester segment has a content X (mol %) of the unit derived from the monomer (b) of 1.0 to 20 mol % as calculated from $X=\{Mb/(Ma+Mb)\}\times 100$ where Ma (mol/g) is the number of moles of the unit derived from the monomer (a) per unit mass, and Mb (mol/g) is the number of moles of the unit derived from the monomer (b) per unit mass, and a melting point of the graft polymer is 50 to 85° C.

* * * * *